United States Patent [19]

Katayama et al.

[11] 4,095,879

[45] Jun. 20, 1978

[54] COLOR COPYING APPARATUS

[75] Inventors: Hajime Katayama, Tokyo; Akiyoshi Torigai, Machida; Masashi Suda, Irima; Osamu Hoshino, Kawasaki, all of Japan

[73] Assignee: Canon Kabushiki Kaisha, Tokyo, Japan

[21] Appl. No.: 705,439

[22] Filed: Jul. 15, 1976

Related U.S. Application Data

[63] Continuation of Ser. No. 531,385, Dec. 10, 1974, abandoned.

[30] Foreign Application Priority Data

| | | |
|---|---|---|
| Dec. 13, 1973 | Japan | 48-140959 |
| Dec. 19, 1973 | Japan | 48-143214 |
| Dec. 19, 1973 | Japan | 48-143215 |
| Dec. 20, 1973 | Japan | 48-143065 |
| Dec. 20, 1973 | Japan | 48-143069 |

[51] Int. Cl.[2] ..... G03G 15/01

[52] U.S. Cl. ..... 355/4; 355/14

[58] Field of Search ..... 355/4, 14; 96/1.2

[56] References Cited

U.S. PATENT DOCUMENTS

| | | | |
|---|---|---|---|
| 3,724,943 | 4/1973 | Draugelis et al. | 355/4 |
| 3,947,114 | 3/1976 | Washio et al. | 355/4 |

*Primary Examiner*—W. M. Shoop, Jr.

*Attorney, Agent, or Firm*—Fitzpatrick, Cella, Harper & Scinto

[57] ABSTRACT

In a copying apparatus wherein electrostatic latent images having color components of an original image are sequentially formed and developed on a moving photosensitive medium, there is provided exposure means for projecting therethrough an original image upon the photosensitive medium for exposure, filter means including a predetermined number of color resolving filter units selectively movable onto the projection path of the exposure means, image forming means disposed adjacent the photosensitive medium to form an image corresponding to the projected image, and program control means for causing the exposure means and filter means to cooperate together to control the image forming means in accordance with the color to be reproduced.

19 Claims, 29 Drawing Figures

COLOR COPYING APPARATUS

This is a continuation, of application Ser. No. 531,385, filed Dec. 10, 1974, and now abandoned.

BACKGROUND OF THE INVENTION

1. Field of the Invention

This invention relates to a color copying apparatus in which color-resolved images of an original image are sequentially formed through color resolving filter means, and more particularly to a color copying apparatus which enables the image forming process to be easily set up in accordance with the color to be reproduced and which permits good image reproduction to be achieved at high speeds.

2. Description of the Prior Art

The color copying apparatuses heretofore proposed have been based on any one of various systems such as the fax type which involves the steps of color-resolving a multi-colored original image into color components by red, green and blue filters, effecting exposure and development on photosensitive paper for each of the color-resolved images and fixing a final image on the paper, and the image transfer type which involves the steps of effecting image reproductions sequentially on a single photosensitive medium for each color component and transferring the formed images onto transfer paper in superposed relationship or effecting image formations simultaneously on a single photosensitive medium or on a plurality of such mediums for each color component and transferring the formed images onto transfer paper in superposed relationship, and thereafter fixing the final image.

An example of the apparatus in which color-resolved images are formed in superposed relationship directly on photosensitive paper is disclosed in U.S. Pat. No. 3,467,468 by Sigurd W. Johnson (filed Mar. 30, 1967 and patented Sept. 16, 1969). In this apparatus, photosensitive paper is fixedly disposed and may be scanned by process means to ensure good registration.

An example of the apparatus in which color-resolved images are transferred onto transfer paper in superposed relationship is disclosed in U.S. Pat. No. 3,734,607 by Howard C. Davis et al. (filed June 4, 1969 and patented May 22, 1973). In such apparatus, flash exposure is adopted for the speed-up of copying and therefore, a belt-like photosensitive medium is employed to provide an exposure plane.

Besides these, other various designs of apparatus have been proposed and in any of them, it is an ideal to realize color reproduction with good registration and good color balance and at high speeds, whereas it has often been the case that efforts for good registration have sacrificed the copying speed and efforts for higher copying speeds have sacrificed the registration or the color balance. Further, color reproduction, as compared with the conventional black-and-white reproduction, requires the number of controls to be increased with the number of colors and this might lead to greater complexity of the program mechanism for changing over the color cycles. It would be very useful if it were possible to select a number of colors as desired and obtain a desired color reproduction, but in fact there are few or no practical apparatus which can carry out color reproduction through a simple control program.

Objects of the present invention will therefore be appreciated from the various points enumerated below and the following detailed description made of a specific embodiment.

SUMMARY OF THE INVENTION

It is a primary object of the present invention to provide a copying apparatus which can accomplish good color reproduction at high speeds.

It is another object of the present invention to provide a color copying apparatus which enables color reproduction cycles to be controlled with ease.

It is a further object of the present invention to provide a copying apparatus which can produce a colored image with good registration and good quality.

It is still a further object of the present invention to provide a copying apparatus in which various process means for enabling high-speed image reproduction are effectively associated together.

Generally describing the present invention, the process control for multi-color reproduction is effected with a reference imparted first by position control of filter means to ensure good process control to be achieved. More specifically, color-resolving filter units of the filter means are controlled such that they come to an effective position in a predetermined sequence, that their start positions are set up in accordance with respective color reproducing cycles and that each filter returns to such start position corresponding to a selected color cycle, whereafter the processing operations occur. By giving priority to the filter control, the present invention simplifies and improves the control sequence for multi-color reproduction and also facilitates the selection of color for monochromatic reproduction, thereby realizing good image reproduction.

DESCRIPTION OF THE PREFERRED EMBODIMENTS

Figure 1:
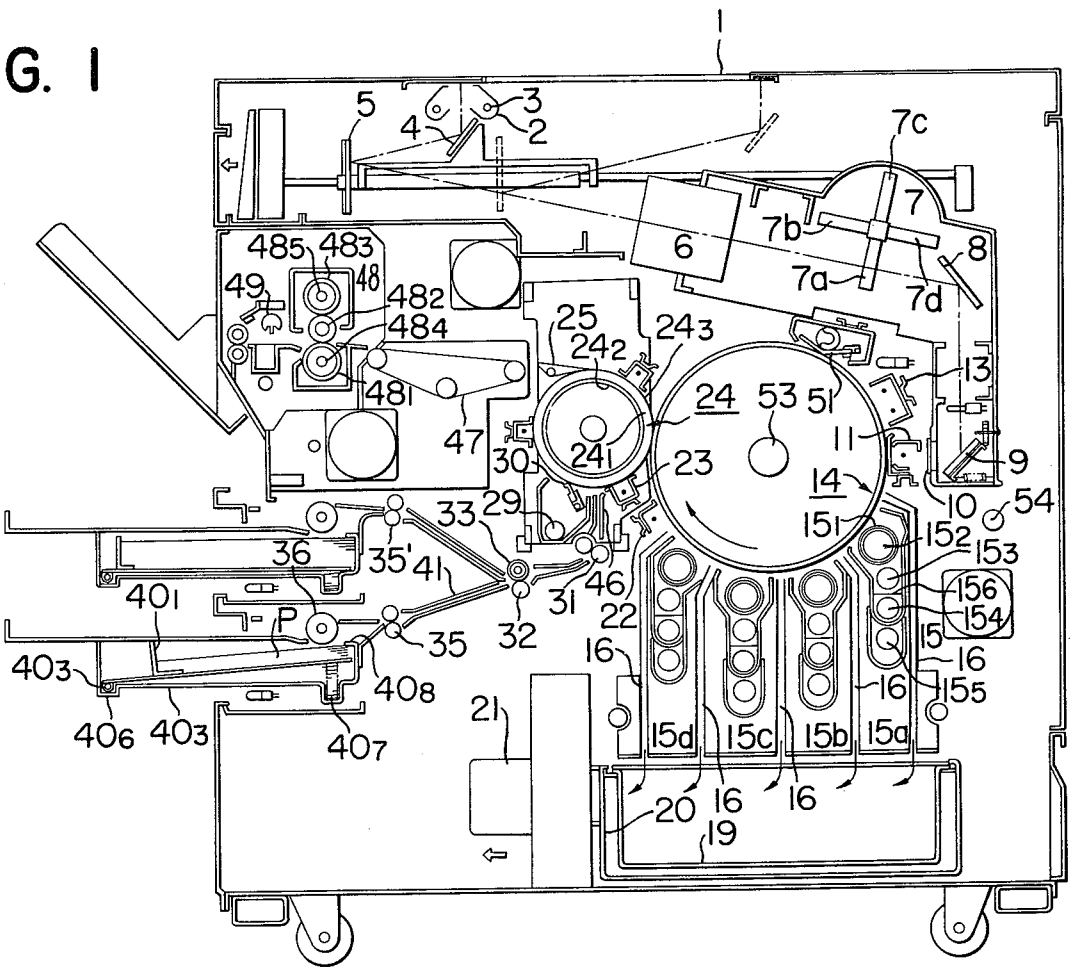
FIG. 1 is a front view illustrating an embodiment of the color copying apparatus according to the present invention.

FIG. 1 shows an embodiment of the color copying apparatus according to the present invention.

An original on an original carriage glass 1 is illuminated by illuminating means comprising iodine lamps 3 and reflectors 2 and formed integrally with a first scanning mirror 4, and is scanned by the first scanning mirror 4 and a second scanning mirror 5. In scanning the original, the first and second scanning mirrors 4 and 5 are moved at a velocity ratio of 1 : ½ to thereby maintain the first half of the optical length of a lens system 6 constant at all times. The length to be scanned may be set to a desired length in accordance with the size of copy as will hereinafter be described. The mechanism therefor will later be described in detail.

The reflected image light of the original passes through the lens 6 to color resolving filter means 7, so that the image light is color-resolved by any one of filters 7*a*, 7*b* and 7*c* corresponding to three colors, namely, red, green and blue, and the color-resolved image is directed by a stationary mirror 8 and a fourth mirror 9 and through a dust-proof sealing glass 10 and focused on a photosensitive drum 14. The photosensitive drum 14 is rotatably mounted on a shaft 53 and is rotatable in the direction of arrow upon actuation of a copy button to effect the formation of a latent image thereon. Various types of known electrophotographic methods are of course applicable to the process of latent image formation and in the shown apparatus, the process disclosed in U.S. Pat. No. 3,666,363 by Hiroshi Tanaka et al. (filed Feb. 18, 1971 and patented May 30, 1972) is used as an example.

Therefore, the surface of the photosensitive drum 14 is charged (with the positive polarity, for example) by a primary charger 13 prior to exposure, whereafter it is exposed to the above-described color-resolved image while being deelectrified by an AC discharger 11, and then illuminated uniformly throughout the entire surface by an overall illuminating lamp 54, thus providing an electrostatic latent image of high contrast.

The electrostatic latent image on the photosensitive drum 14 is then visualized by a developing device 15. The developing device 15 comprises four developing units 15*a*, 15*b*, 15*c* and 15*d* for cyan, magenta, yellow and black, and the image visualization is effected by a developing unit corresponding to the operated color resolving filter (for example, the yellow developing unit 15*c* for the blue filter). The developing device may of course be of the known type, and in some cases may be a developing device which uses liquid developer. The developing unit shown herein will further be described under the section "Developing Device".

Suction ducts 16 are provided forwardly and rearwardly of each developing unit, and these ducts are connected through a toner collecting filter 19 in a toner filter box 20 to a suction blower 21 so that any toner or carrier scattered from the developing device is sucked into these ducts to prevent it from mixing with any other developer. Such suction arrangement is also useful to prevent the interior of the apparatus from being contaminated and to protect the operator hygienically. After development, the dust image on the photosensitive drum is charged with any desired polarity by a post-charger 22, whereafter it reaches a transfer station.

On the other hand, transfer mediums P are accommodated in a cassette 40 detachably mounted with respect to the body of the apparatus. Although the cassette 40 will further be described, it includes an intermediate plate $40_7$ mounted for pivotal movement about a shaft $40_{10}$ secured to an outer housing $40_1$, a spring $40_9$ normally biasing the intermediate plate upwardly, a size change-over plate $40_4$ for the transfer mediums, a separator pawl $40_3$, etc., and the cassette can accommodate therein various sizes of transfer mediums.

In the shown position of the apparatus, two similar cassettes are provided in two upper and lower stages and accommodate therein different sizes of paper, respectively. When either of the upper and lower cassettes is selected by means of a selector button in an operating portion provided in the upper portion of the apparatus body, a feed roll 36 is rotated with rotation of the photosensitive drum as the roll is lowering into contact with the uppermost sheet of transfer medium in the selected cassette, and the roll is further lowered so as to permit the separator pawl $40_3$ to operate from its own weight, whereby the feed roll feeds the uppermost sheet of transfer medium P from the cassette. Concurrently with the operation of the feed roll 36, a first pair of timing rolls 35 is stopped and the transfer medium P fed from the cassette strikes against the timing roll to form a loop and comes to a momentary halt, whereafter the transfer medium P is passed through a guide 41 and between a pair of transport rolls 32 and 33 to reach a second pair of timing rolls 31. The second timing rolls 31 are stopped from rotating slightly before the fed transfer medium reaches them, so that the transfer medium P strikes against the second timing rolls 31 and comes to a halt while forming a loop. Thereafter, the second timing rolls 31 are again operated in synchronism with the dust image formed on the photosensitive drum.

Whichever cassette may be selected, the synchronization of the image transfer may be satisfactorily realized irrespective of the position, by the action of the first and second timing rolls. The transfer medium P is passed through a guide 46 into contact with a transfer roll 24, and then subjected to corona discharge from the back side thereof by an electrostatic attracting charger 23 which is opposite in polarity to a post-charger 22, whereby the transfer medium P is electrostatically attracted to the transfer roll 24.

The transfer roll 24 comprises a resilient roll $24_1$ covering a metal roll $24_2$, and an outermost layer of electrically conductive rubber $24_3$ wrapped around the resilient roll, and is grounded. The transfer medium P electrostatically attracted to the transfer roll 24 is synchronized with the dust image on the photosensitive drum and urged thereagainst so that the dust image is transferred onto the transfer medium to form a yellow dust image thereon.

The similar process of image formation is repeated as often as is required for the number of colors, by effecting the change-over between the filters of various colors such as red and green. Thus, the transfer medium P on the transfer roll undergoes the image transfer three times in all while remaining electrostatically attracted to the transfer roll.

In that process, paper feed is effected in timed relationship with the first image formation and this occurs without any mechanical error because the diameter ratio between the photosensitive drum and the transfer drum is selected to an integral ratio of 2 : 1 and because these two drums are connected together by gearing. Accordingly, any possible misregistration during the subsequent repetition of image transfer may be eliminated. As will further be described, the color resolving filters 7 are sequentially changed over during each backward stroke of the optical scanning system while the developing units to be driven are also changed over in response to the filter change-over.

After the color resolutions by the red, green and blue filters, the exposure to the color-resolved images, the development by cyan, magenta and yellow toners and the three-fold image transfers have all been completed, a separator pawl 25 is operated by a program device so as to separate the electrostatically attracted transfer paper from the transfer roll 24, and then it is moved on a conveyor belt 47 to a fixing device 48.

Fixation may be accomplished by any suitable fixing device of the heat-fixing type such as infrared ray heater or the like, or of the pressure-fixing type. The present embodiment of the apparatus uses heating rollers and will later be described in detail.

In such a fixing device, the dust image on the transfer medium P is heated and melted for fixation, and the electrostatic charges on the transfer medium are removed by a discharge 49, whereafter the transfer medium is discharged into a tray. After the separation of the transfer medium P, a transfer roll cleaner 30 is operated to clean the transfer roll at the dictation of the program device, and the toner so wiped off by the blade cleaner is conveyed by an underlying screw 29 in one direction and collected in a toner receptacle.

After the dust image of each color has been transferred, the photosensitive drum 14 has its surface cleaned by a cleaning device comprising a resilient blade 51, and then enters a subsequent cycle. A lamp 17 is provided to prevent the fatigue of the photosensitive drum which might result in variation of its sensitivity. Lamps 18 are provided at the opposite ends deviated from the effective optical path, and designed such that they are turned on during OFF-condition of the exposure lamps (i.e. during the backward stroke of the optical system) to erase the charges present between the images on the drum to thereby prevent unnecessary toner from sticking to the surface of the drum. On the other hand, after the transfer medium P has been separated, the transfer roll cleaner 30 is operated at the dictation of the program device to clean the transfer roll, and the toner thus removed by the cleaner is conveyed by the underlying screw 29 for collection into the toner receptacle.

Figure 2:
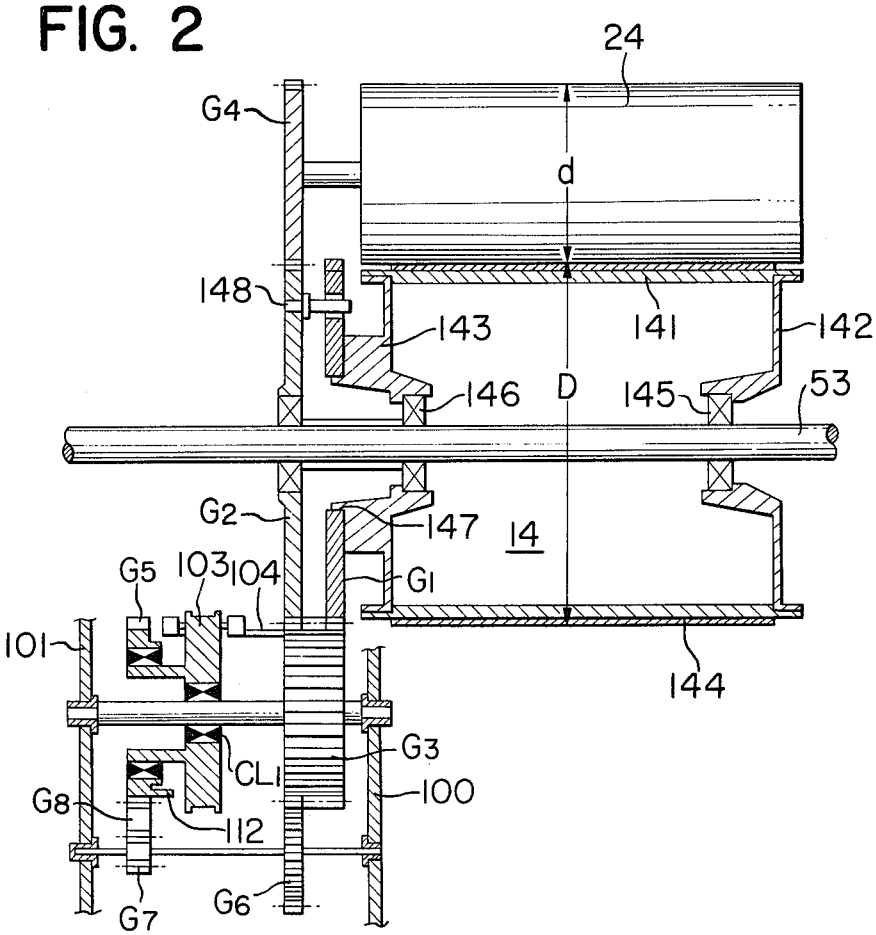
FIG. 2 illustrates the driving relationship of a photosensitive drum with a transfer roller and an optical system.
Figure 3:
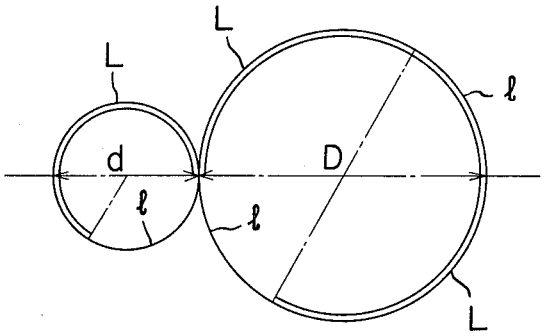
FIG. 3 particularly shows the relationship between the photosensitive drum and the transfer roller.

FIG. 2 illustrates an optical system driving mechanism which enables good registration to be provided between sequentially formed images.

The photosensitive drum 14 comprises a metal drum 141 provided with a front 142 and a rear flange 143, and a photosensitive medium 144 provided over the surface of the metal drum, which photosensitive medium may have a photoconductive layer of Se or like material or a photoconductive layer of CdS or like material having the surface thereof covered with an insulating layer. The two flanges are rotatably journalled to a center shaft 53 by means of ball bearings 145 and 146, respectively. The rear flange 143 is provided with a spigot portion 147 to which a drum's driven gear G1 meshing with a drive gear G3 is secured concentrically with the photosensitive drum. This eliminates any influence which would otherwise result from the eccentricity of the gear with respect to the outer peripheral surface of the drum, and accordingly eliminates any variation in the peripheral speed of the drum which would result from said eccentricity. A control gear G2 having the same number of teeth as the gear G1 is rotatably mounted on the center shaft 53 in proximity to the gear G1. The gear G2 is fixed against axial movement and has a guide pin 148 fixed to one side thereof. On the other hand, the drum's driven gear G1 has a guide hole 149 formed in a prescribed location thereof for receiving the guide pin 148. The guide pin and guide hole arrangement serves to hold the relative position of the photosensitive drum 14 to the control gear G2 during mounting of the drum and to provide a smooth meshing of the gear G2 with the gear G3. On the other side of the control gear G2, control cams C1–C6 (FIG. 4) are provided in such a manner that two cams of each set are 180° out of phase so as to control the optical system drive, the timing of paper feed, etc., as will further be described.

In the shown construction of the apparatus, the photosensitive medium 144 over the drum is in a non-endless form and has a length sufficient for the formation of two images per complete rotation, and the diameter ratio between the drum 14 and the transfer roller 24 is 2 : 1. Thus, one and a half rotation of the photosensitive drum and three complete rotations of the transfer roller result in production of a colored image. Therefore, the transfer roller 24 is connected to the drum's driven gear G1 by a gear G4 having a number of teeth half that of the gear G1 in order to maintain its relative position to the photosensitive drum 14.

The drive gear G3 is mounted on a shaft 102 which also rotatably mounts thereon an optical system driving pulley 103 and a reversing gear G5. The driving pulley 103 is mounted to the shaft 102 with a one-way clutch CL1 therebetween, and the reversing gear G5 is mounted to the boss of the driving pulley 103 with a one-way clutch CL2 therebetween.

Figure 4:
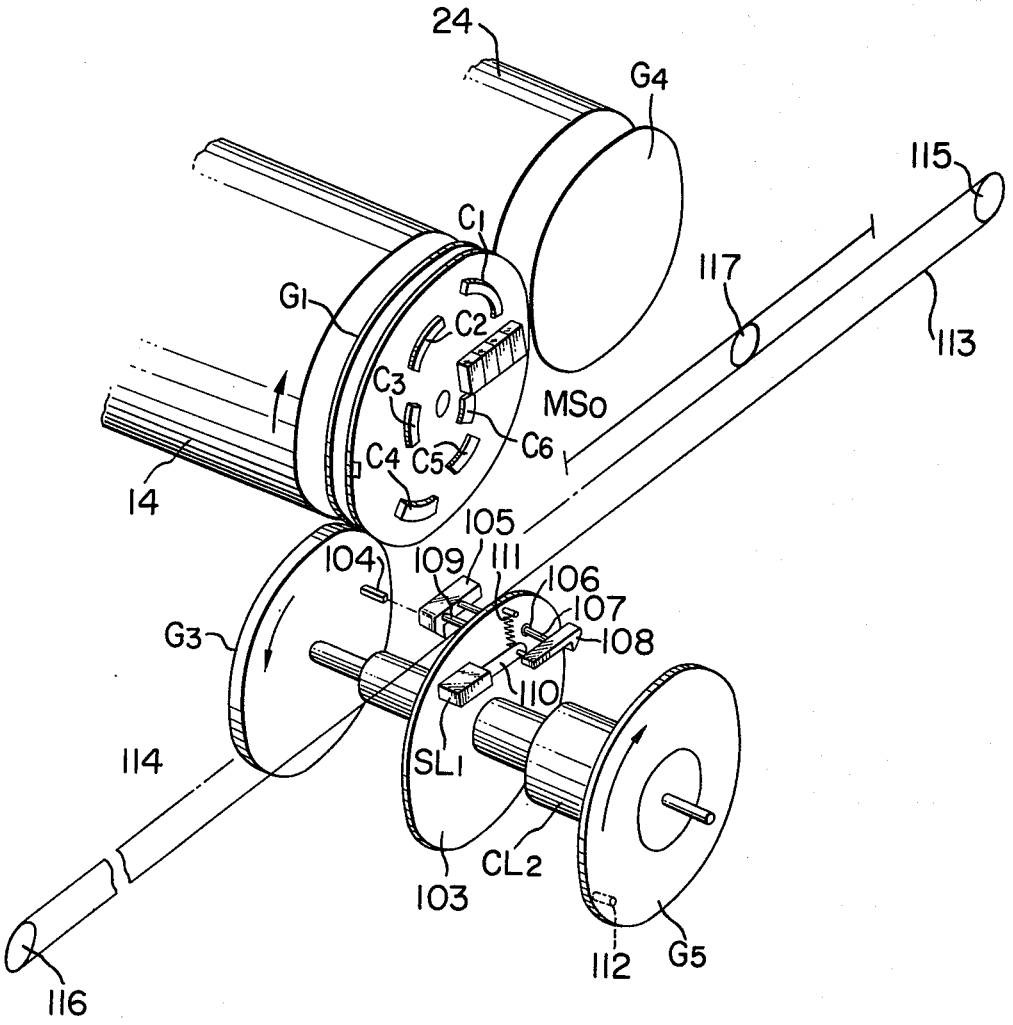
FIG. 4 is a perspective view illustrating a driving mechanism for optical system.

The one-way clutch CL1 is designed to lock the driving pulley 103 when the latter is driven clockwise and attains a peripheral speed higher than that of its partner member, while the one-way clutch CL2 is designed to lock the driving pulley 103 when the latter is driven counter-clockwise than that of the partner member. The purpose of such design is to ensure that when an engaging member 104 on the gear G3 engages an engaged member 105 on the optical system driving pulley 103, which member 105 is capable of selecting two positions, to transmit the drive to the pulley 103, the driving pulley be prevented from making premature rotation or vibration due to starting shock which might result in blur of the formed image. This arrangement can reduce the preparatory running stroke required for the optical system to attain its rising. As shown in FIG. 4, shaft 107 extends through and is journalled to the driving pulley 103 by means of a bearing 106, and engaged members 105 and 108 are secured to the shaft 107 at the opposite ends thereof. A further shaft 109 extends between the two engaged members, and an arm 110 is mounted on this shaft 109 at one end. The other end of the arm 110 is connected to a solenoid SL1 fixed on the driving pulley 103. A return spring 111 is secured to the shaft 109 to normally bias the engaged member 108 toward a first operative position. The first operative position is that in which the engaged member 108 is engaged by an engaging member 112 on the reversing gear G5. There is also a second operative position in which the engaged member 105 is engaged by the engaging member 104 upon energization of the solenoid SL1. The engaged members 105 and 108 are thus mounted for seesaw movement with respect to the shaft 107 so that one of the engaged members is in the first position while the other is in the second position, whereby no interference occurs between the operations of the two members.

The outer peripheral surface of the driving pulley 103 is on a radius half that of the photosensitive drum 14, and one end of each of driving wires 113 and 114 is secured to that peripheral surface of the pulley 103. The wire 113 extends therefrom and over a deflection pulley 115 to rotate a pulley 117 integral with the second mirror 5 and has the other end secured to the body of the apparatus. Likewise, the wire 114 extends from the driving pulley 103 and over a deflection pulley 116 to rotate the pulley 117 and has the other end secured to the body of the apparatus.

Thus, when rotated in one direction, the pulley 103 winds up the wire 113 thereon while it unwinds the wire 114, so that the first and second mirrors 4 and 5 scan the object at a speed ratio of 1 : ½. When the magnification for copies is unity, the velocity at which the drive pulley 103 winds up the wire is equal to the peripheral speed of the photosensitive drum.

In the above-described construction, when the copy button is depressed to cause a drive motor MT1 to drive the gear train to rotate the driving gear G3 and the reversing gear G5 in the opposite directions and at a speed ratio, say, 1 : 4, the photosensitive drum 14 and the transfer roller 24 are driven in rotation. By presetting a position in which the engaging member 112 on the reversing gear G5 engages the engaged member 108, the drive of the reversing gear G5 rotates the driving pulley in a direction to return the scanning mirrors 4 and 5 to their initial position. At the point of time when the scanning mirrors have reached their initial position, the solenoid SL1 is energized by a signal from the cam C6 on the control gear so that the engaged member 105 is pivoted to a second position through the agency of the arm 110, as a result of which the connection between the engaging member 112 and the engaged member 108 is broken, which is followed by engagement between the engaging member 104 and the engaged member 105, whereby the driving pulley 103 is rotated while the exposure lamps are turned on and scan the object to be copied. At the point of time when the scanning is completed, the signal from the cam C6 is cut off to deenergize the solenoid SL1, which in turn permits the engaged member 105 to be returned to its first position out of engagement with the driving gear G3 by the spring 111, thus completing a first cycle of exposure. A similar operation is repeated three times for red, green and blue, whereby there is produced a colored copy.

The change-over between the forward and backward strokes is accomplished by the solenoid SL1 being electrically energized by a signal from the cam, but alternatively this may of course be accomplished by a mechanical means alone.

Further, in the foregoing embodiment, the number of revolutions of the transfer roller 24 and the number of revolutions of the gear G3 provided with the engaging member 104 are equal, whereas they need not be equal if a plurality of such engaging members are provided and the spacing between adjacent ones of such members is made equal to the peripheral length of the transfer roller in one complete revolution. Although an engaging member is provided also for the reversal of the optical system, it will be apparent that the drive for such reversal may equally be accomplished by a separate independent drive source.

Depending on the size of the original to be copied, there are some cases where the entire surface of the original carriage need not be scanned. In such cases, reducing the distance of scanning would be effective. For example, in the present embodiment of the apparatus wherein one full rotation of the photosensitive drum results in the formation of two images equal in size to the entire surface of the original carriage, if an original half the size of the carriage surface is to be copied, it will be possible to form four images for one complete rotation by reducing the distance of scanning for the original down to one half and repeating the scanning, and this will mean a very high speed of image reproduction. In the shown embodiment, however, this would require that each resolved color image be formed in a set of two images, when the relationship with the transfer roller is taken into account, but it will still be clear that this is highly effective in that the whole copying time can be reduced to approximately half the time required when the original carriage is scanned throughout its entire surface.

Figure 5:
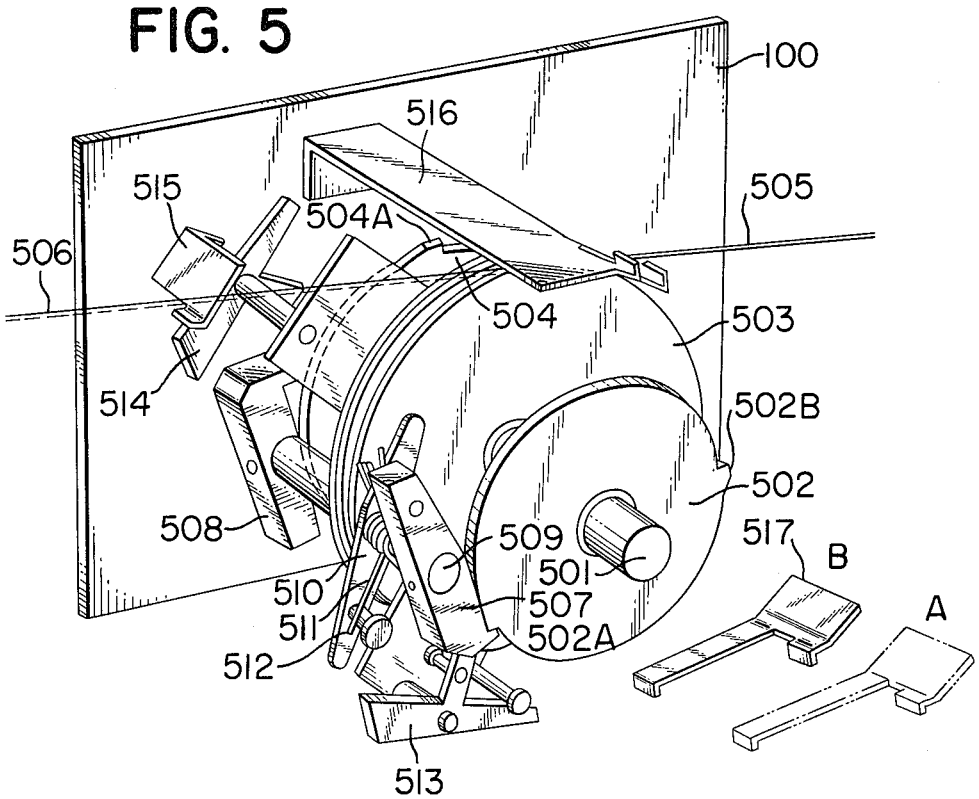
FIG. 5 is a perspective view illustrating a mechanism for changing the scanning length of the optical system.

Description will now be made of an embodiment wherein only mechanical means is used to change over the distance of scanning in accordance with the size of the original to be copied. FIG. 5 shows an arrangement which enables the above-described reciprocation to be accomplished by mechanical means alone.

A machine frame 100, only partly shown, supports a rotatable shaft 501 for holding thereon a driving pulley 503 and some other members. Designated by 502 is a forward stroke disc rotatable by extraneous drive in counter-clockwise direction (as viewed) with respect to the photosensitive medium. The forward stroke disc 502 is provided thereon with forward stroke engaging pawls 502A and 502B about 180° out of phase with each other and these correspond to the gear G3 and its engaging member 104 in the mechanism previously described. Designated by 504 is a backward stroke disc rotatable by extraneous drive in clockwise direction and at an integral speed ratio with respect to the forward stroke disc 502. The backward stroke disc 504 has provided thereon a backward stroke engaging pawl 504A and these correspond to the gear G5 and its engaging member 112 in the mechanism previously described. The driving pulley 503 is for winding and unwinding the wires 505 and 506, and engaged members 507 and 508 are loosely mounted to the driving pulley at the opposite sides thereof by means of a shaft 509. A change-over lever 510 is loosely mounted on the shaft 509. A spring 511 is provided to bias the engaged member 507 clockwise and a second spring (not shown) is provided to bias the engaged member 508 counter-clockwise. Stops 513 and 514 are loosely mounted at the opposite sides of the driving pulley 503 for holding the engaged members 507 and 508 in their predetermined positions.

On the machine frame 100, there are fixedly provided forward and backward stroke actuator members 515 and 516 for actuating the change-over lever 510. A movable backward stroke actuator member 517 is disposed at a location opposite to the backward stroke actuator member 516. The movable actuator member 517 is supported for movement between its retracted position A and its operative position B by an extraneous signal.

With the described arrangement, when the stop 514 strikes against the forward stroke actuator member 515, the forward stroke engaging pawl 502A comes into engagement with the engaged member 507 to cause the driving pulley 503 to wind up the wire 505, thus initiating the scanning of the original. When the terminus of the forward stroke is reached, the change-over lever 510 and the stop 513 strike against the backward stroke actuator member 516 or 517 to break away the engagement between the forward stroke engaging pawl 502A and the engaged member 507 while bringing the backward stroke engaging member 504A into engagement with the engaged member 508, thereby reversing the driving pulley 503 for backward stroke. When the movable actuator member 517 is moved by an extraneous signal to its operative position which is substantially the center of the full size scanning stroke, the change-over lever 510 and other members are actuated in that position to initiate the reversal to the backward stroke, and therefore it will readily be understood that the optical scanning stroke at this time is half the full-size stroke. Thus, optical scanning of any size may be realized by providing the movable actuator member at any desired location.

DEVELOPING DEVICE

Figure 6:
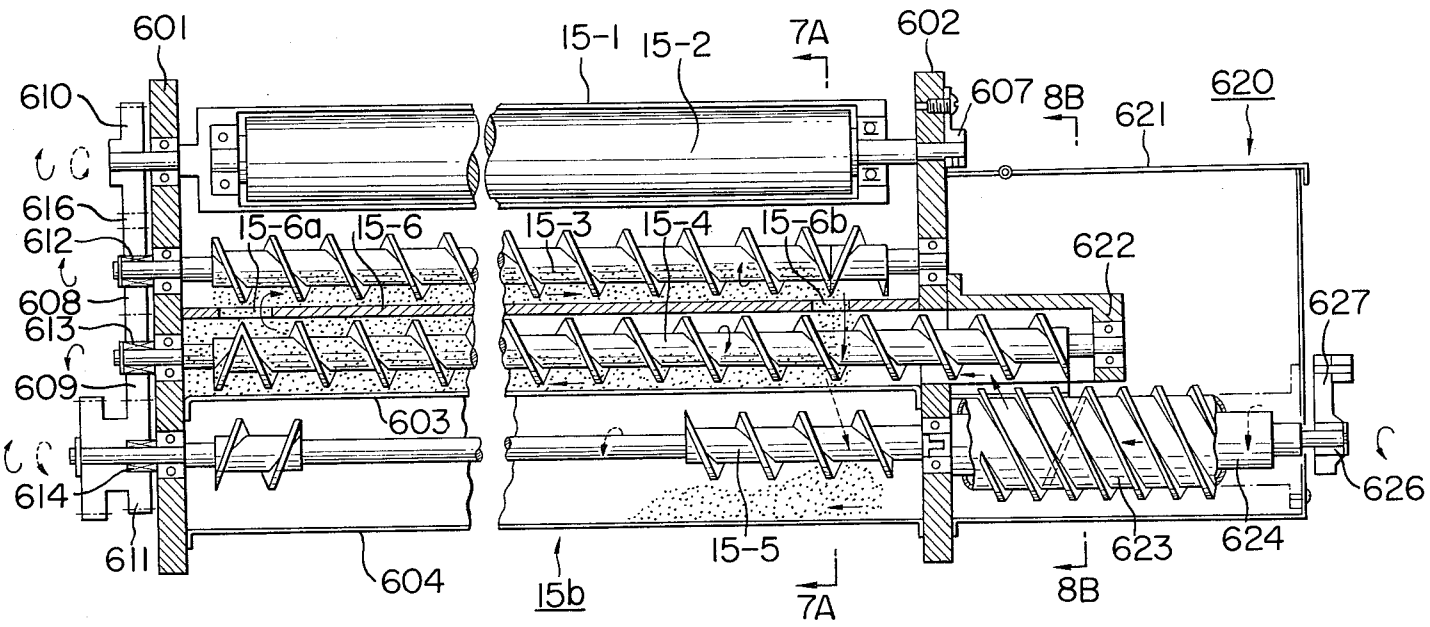
FIG. 6 shows, in cross-section, a developing device.
Figure 7:
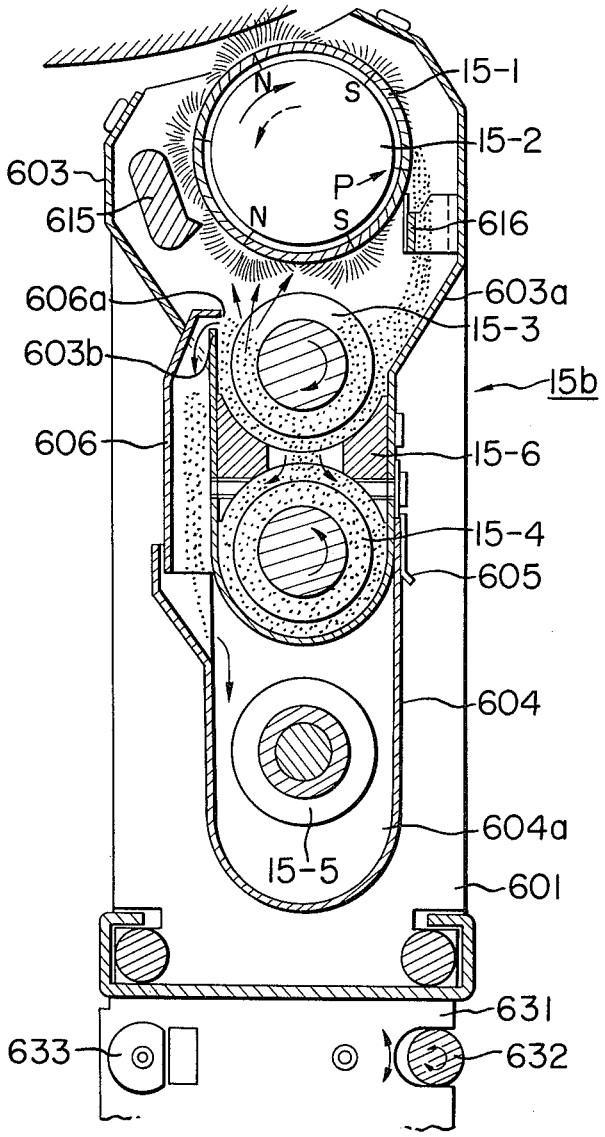
FIGS. 7 and 8 are cross-sectional views taken along lines 7A—7A and 8B—8B, respectively, of FIG. 6.
Figure 8:
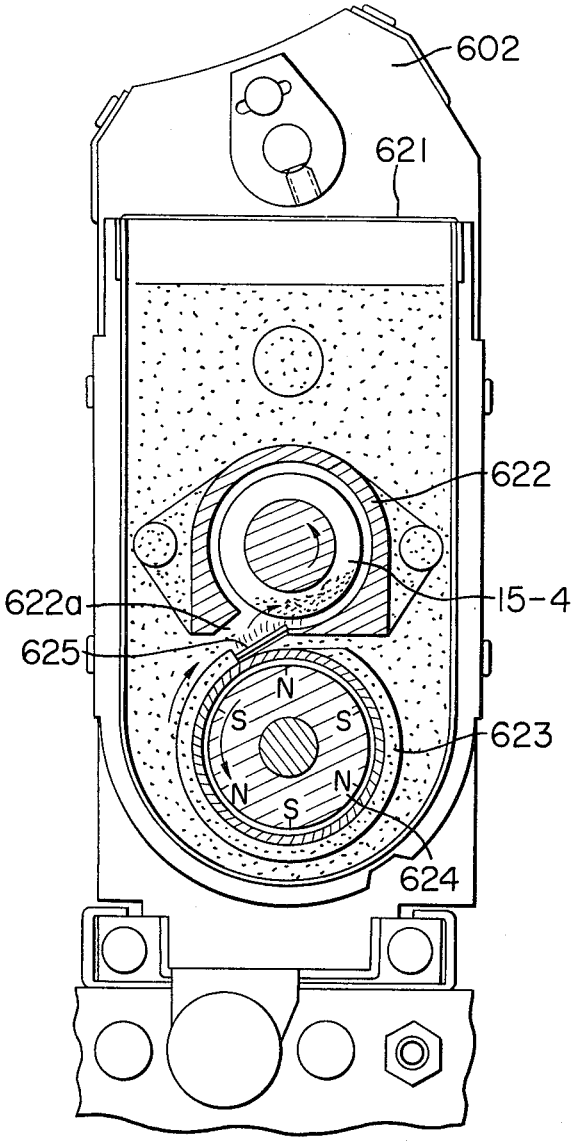

FIG. 6 illustrates the developing device in the present embodiment of the apparatus. FIGS. 7 and 8 are cross-sectional views taken along line 7A—7A and 8B—8B, respectively, of FIG. 6.

Within a sleeve 15-1 of non-magnetic material there is a magnet 15-2, and these are supported for rotation relative to each other. As shown in FIG. 7, the magnet has poles at five of six angularly equally spaced points on the circumference thereof, and at a point P a pole may not be provided or a magnet of the same polarity as that before or after the point P may provided. (In the vicinity of the point P, magnetic force of the same polarity as the developer acts to repulse the developer which is thus released from the magnetic force to fall downwardly.) A scraper 616 of non-magnetic material is provided below the point P of the sleeve to assist and guide the falling of the developer more effectively. The magnet 15-2 has one end secured to an adjust plate 607 for adjusting the magnet so as to direct its main pole toward the surface to be developed, and is fixed to the front plate 602 of the developing device. On the other hand, a shaft provided on the other end of the sleeve rotatable relative to the magnet is rotatably supported on a rear plate 601 by means of bearing.

A doctor blade 615 of non-magnetic but electrically conductive material for controlling the fluffing of the developer on the sleeve 15-1 is provided in proximity to a pole of the magnet 15-2. This blade, with the sleeve, forms a pair of detecting electrodes in an automatic density detector device for detecting the density of toner (which will further be described), and performs the function of detection. Therefore, the doctor blade 615 and the sleeve 15-1 are held insulated with respect to the front and rear plates 601 and 602, and are electrically connected together so as to permit a predetermined voltage to be applied to each other.

A hopper unit 620, seen at the right end of FIG. 6, includes a toner storage container 621 attached to the front plate 602, and a supply screw 623 for supplying the toner from the container into the developing device.

The supply screw 623 of non-magnetic material, as shown in FIG. 8, surrounds a magnet 624 having its successive poles alternately arranged and holds the magnet by means of self-aligning bearings loosely fitted to the opposite shaft end portions, with one end of the supply screw 623 being fixed to the container 621. Since, unlike the developing sleeve 15-1, the supply screw surrounding the magnet is fixed and the magnet is rotatable relative to the screw, toner particles rotate and revolve in the direction opposite to the direction of rotation of the magnet, thus advancing on the screw along its threads.

Within the developing device, an upper screw 15-3 and a lower screw 15-4 are provided to convey the developer supplied from the hopper unit to the developing sleeve and to provide for good agitation and circulation of the developer. Each of these screws has one shaft end thereof journalled to the rear plate 601 by means of bearings. The other end of the upper screw 15-3 is journalled to the front plate 602 by means of a bearing and the other end of the lower screw 15-4 is journalled to a bracket 622 by means of a bearing, the bracket extending into the hopper unit and having toner supply ports. The bracket 622 is attached to the front plate 602 with their toner supply ports facing the above-described supply screw 623.

The relative position of the supply screw 623 and the lower screw 15-4 may be selected as desired, but when the developer used consists of carrier and toner, the supply screw 623 is preferably disposed below the lower screw. The reason is that since free toner liberated from the carrier is stored at the bottom of the container 621, a predetermined quantity of the toner can be attracted and supplied from the supply screw 623 to the lower screw 15-4 when the toner is conveyed upwardly.

Figure 9:
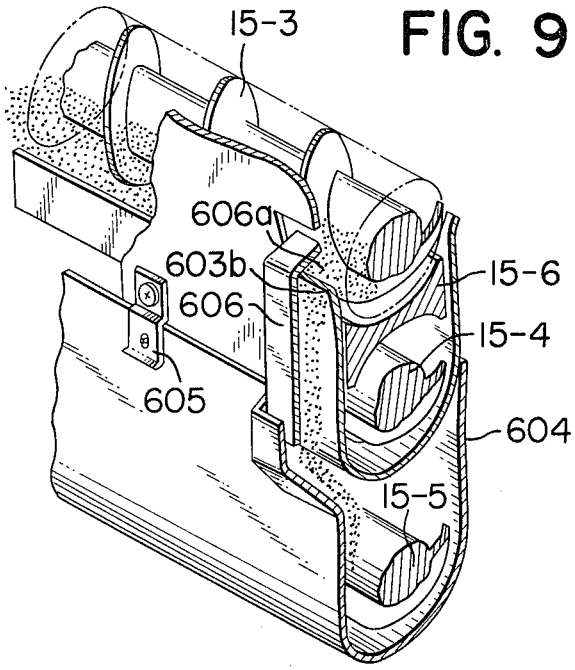
FIG. 9 is a perspective view illustrating the overflow effect of the developing device.

In the present embodiment of the apparatus, there is further provided overflow treating means which also serves to remove deteriorated developer. As shown in the perspective view of FIG. 9, the path for conveying the developer overflown from an opening **606*a* in the upper screw cover into an underlying overflow container 604 detachably held by a spring 605 is formed into a substantially hermetically sealed path by an overflow guide plate 606. The opening 606*a* forms a weir 603*b* for providing a predetermined quantity of overflow to control the falling of any excess developer. An overflow screw 15-5** is provided so as to prevent the developer from accumulating at the point of falling in the overflow container.

The overflow screw 15-5 has one shaft end portion thereof drivingly connected to the magnet 624 and journalled to the front plate by means of bearing, and has the other shaft end journalled to the rear plate by means of bearing. Power transmission gears are mounted on the respective shaft portions journalled to the rear plate. These gears are sleeve gear 610, idler gear 616, upper screw gear 608, lower screw gear 609 and input gear 611. The gears 610, 616, 608 and 609 are drivingly connected to the input gear 611. More specifically, the upper and lower gears 608 and 609, the input gear 611 and a manualy operated supply lever 627 are connected to the respective shafts by means of one-way roller clutches 612, 613, 614 and 606, respectively.

Figure 10:
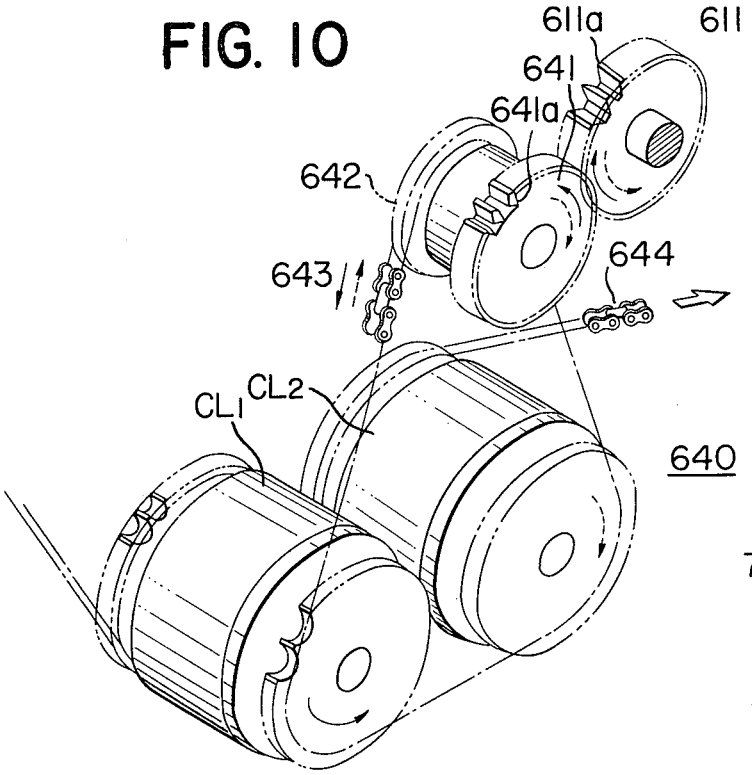
FIG. 10 illustrates, in perspective view, a driving mechanism for developing device.

As illustrated in FIG. 10, the reverse drive unit 640 comprises electromagnetic clutches CL1 and CL2 supplied with an input from a sprocket connected to a wire or chain 644, an output sprocket reversible in its direction of rotation, an output gear 641 integral with a sprocket 642 connected to a chain 643. The output gear 641 has its tooth crests chamfered at 641*a* and the input gear 611 also has its tooth crests chamfered at 611*a*, so that they are smoothly coupled upon insertion of the developing device. Further, in the present embodiment of the apparatus according to the present invention, a voltage is applied between the aforesaid sleeve 15-1 and the doctor blade 615 to detect the density of the developer to thereby control the same appropriately. If a voltage is applied to a set of electrodes with magnetic developer intervening therebetween and if the applied voltage is below 100 to 200 $\mu$V, a current of 1 $\mu$A or less will only flow, that is, an electrical resistance of $10^8\,\Omega$ or higher will be exhibited. However, if the applied voltage is of the order of 200 V or higher, a current of 1 $\mu$A will flow, that is, a resistance of $10^4$ to $10^5\,\Omega$ will be exhibited. Such a phenomenon is believed to be attributable to the short-circuiting resulting from the aerial discharge caused by the dielectric breakdown of the layers of air between carrier particles. Such short-circuiting depends on the applied voltage, degree of oxidization of the carrier, density of the carrier, degree of toner-covering of the carrier, and carrier-toner ratio. The above-described arrangement utilizes such phenomenon to detect the carrier-toner ratio, i.e. density of toner. For example, if the applied voltage is 200 V and if a developer with toner density of 12% is varied by $\pm$1%, then there will occur a variation of 500 $\mu$A $\pm$ 100 $\mu$A and therefore, by detecting such variation value, supply of toner from the hopper may be controlled by a control device. This will ensure a developer of proper density to be supplied for the development.

Operation of the developing device will now be described.

Upon initiation of the developing operation, the clutch CL1 is supplied with a current so that the chain 643 is moved in the direction of solid-line arrow (in FIG. 10, all the directions of movement during ON position of the clutch CL1 are indicated by solid-line arrows), and the gear 642 integral with the sprocket connected to the chain 643 is rotated in the direction of solid-line arrow (FIG. 10). The input gear 611 of the developing device connected to the output gear 641 is rotated in the direction of solid-line arrow without rotating the overflow screw, because the roller clutch 614 transmitting the drive only in the direction of dotted-line arrow intervenes therebetween (FIG. 6). The gear 609, connected to the input gear 611, rotates the lower screw 15-4 through the agency of the roller clutch 613 transmitting the drive only in the direction of arrow, so that the replenishment toner accumulated in the toner supply port is conveyed in the direction of arrow and the developer and replenishment toner falling through the second opening 15-6*b* formed in the partition panel 15-6 are agitated and conveyed.

The gear 608, connected to the gear 609, rotates the upper screw 15-3 through the agency of the roller clutch 612 transmitting the drive only in the direction of arrow, so that the developer containing an appropriate quantity of toner and raised upwardly by the lower screw 15-4 through the first opening 15-6*a* and the developer having its toner content already lost during development are agitated and conveyed in the direction of arrow. By such rotational movements of the upper and lower screws 15-3 and 15-4, the toner is uniformly distributed and supplied to the sleeve portion. On the other hand, the gear 601, connected to the gear 608 through the idler gear 616, is secured to the sleeve 15-1 to rotate the latter in the direction of arrow, whereby the developer uniformly agitated is supplied for the development. A predetermined quantity of the developer is supplied to the lower screw from the hopper which is operated by the automatic density control device. As soon as the developing operation is completed, the clutch CL1 of the reverse drive unit assumes OFF position while the clutch CL2 assumes ON position, so that the chain 643 is moved in the direction of dotted-line arrow to rotate the input gear 611 in the direction of arrow. As a result, the sleeve gear 610 is rotated in the direction of arrow and the sleeve 15-1 is now rotated in the opposite direction from that during development. By the reversed rotation of the sleeve 15-1, the developer which would otherwise tend to pass the point P is permitted to fall down and fail to reach the developing portion, and thus any influence from the developer is completely eliminated. At least one half of a complete rotation in the reverse direction may provide a sufficient effect. Controlled rotation in accordance with the control of the automatic density detector device will also be effective.

The overflow screw 15-5, which does not rotate during the normal rotation of the sleeve, effects rotation during the above-described reverse rotation of the sleeve, so that the magnet 624 connected thereto is actuated in the direction of dotted-line arrow to feed a predetermined quantity of developer into the bracket 622 through the supply port 622*a*. The toner stored in this bracket is conveyed into the developing device during development. On the other hand, the upper and lower screws 15-3 and 15-4 forming the circulation system effect no rotation during the reverse rotation of the sleeve 15-1, because roller clutches 612 and 613 intervene which transmit the drive only in the direction of solid-line arrow.

Control Mechanism

Figure 11:
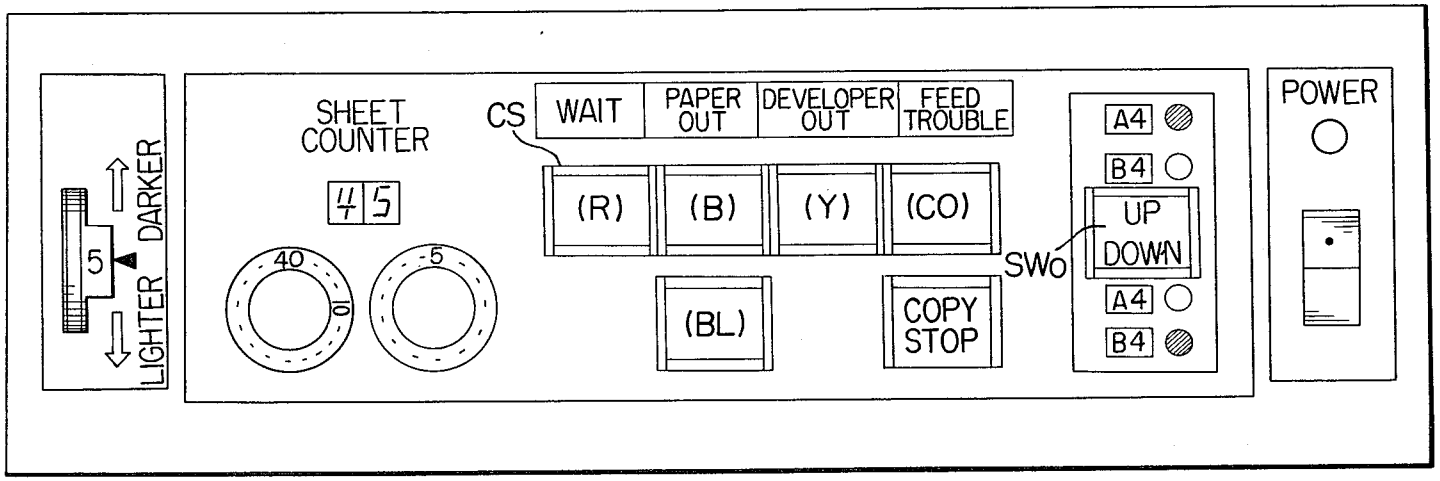
FIG. 11 is a plan view of the operating panel of the apparatus.

FIG. 11 illustrates the operating panel in the embodiment of the apparatus. In the present embodiment of the apparatus, the color selector CS on the operating panel comprises five buttons, i.e. buttons for multi-color (Co), yellow (Y), magenta (M), cyan (C) and black (BL).

Figure 12:
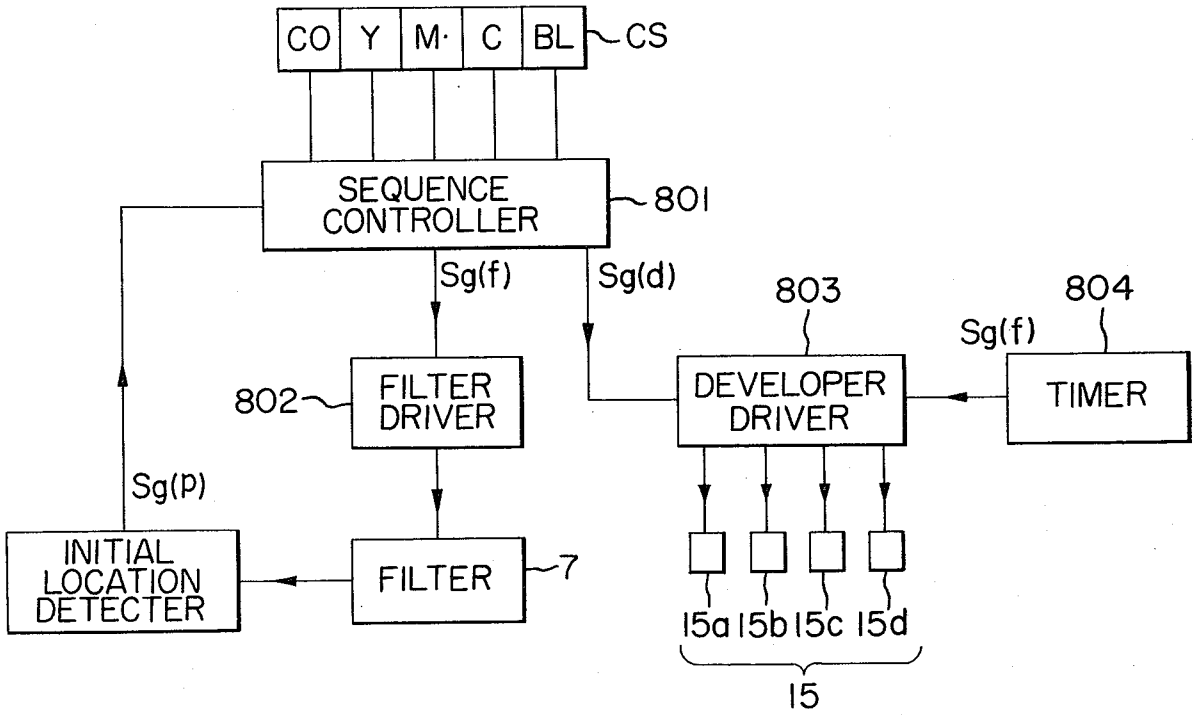
FIG. 12 is a block diagram illustrating the control operation.

As illustrated in the block diagram of FIG. 12 which shows the relationships between the selector and the developing unit, etc., the program for a sequence corresponding to a desired copy reproduction may be selected by selection of buttons in the color selector CS, and a sequence control circuit will generate drive signals such as filter drive signal Sg(f), developer drive signal Sg(d) and the like.

For multi-color reproduction, the color button Co is depressed. A signal produced thereby enters the sequence control circuit 801, which generates drive control signals Sg(f) and Sg(d) corresponding to the color sequence and supplies these signals to a filter drive circuit 802 and a developer drive circuit 803. Since the developing units are arranged in a row in the direction of movement of the photosensitive medium and differ in timing for initiation of development, the timing for driving the respective developing units are controlled by a timing signal Sg(t) from a timing circuit 804. On the other hand, prior to exposure, initial filter location detector means 805 detects the initial location of the filter 7 to control the operations of exposure and development.

Next, for monochromatic reproduction, namely, when one of the buttons Y, M, C and BL is selected, the filter drive circuit 802 generates a drive signal in accordance with the signal from the sequence control circuit 801 so as to set a predetermined filter to the optical path for exposure. The filter location is determined by the initial location being detected by the initial location detector means 805.

On the other hand, the sequence control circuit 801 generates a signal for driving a color developing unit corresponding to the selected color and of course, the timing circuit 804 operates the selected developing unit with a predetermined timing.

Figure 13:
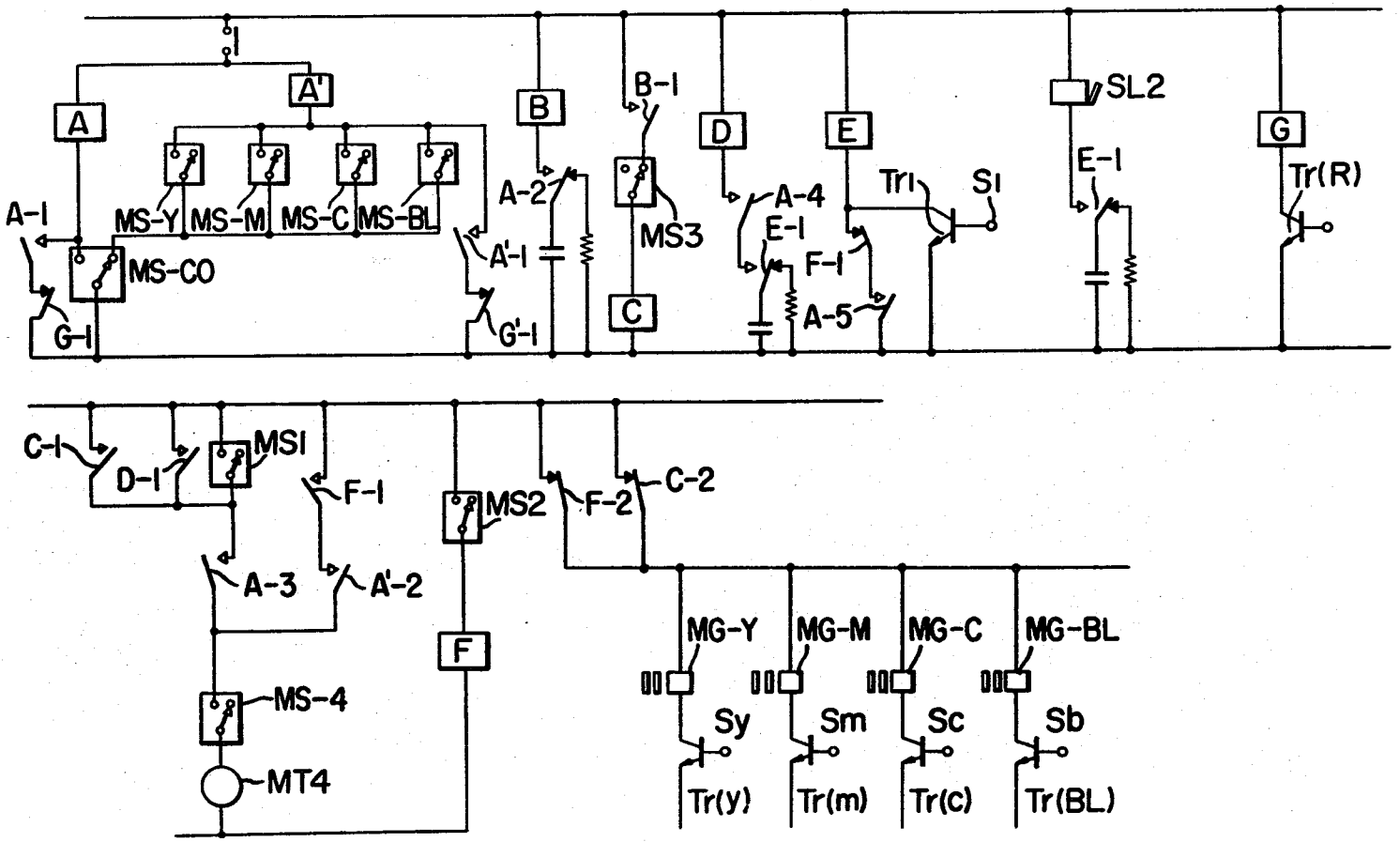
FIG. 13 diagrammatically shows a specific example of the control circuit.

FIG. 13 diagrammatically illustrates an embodiment of the sequence control circuit shown in the block diagram of FIG. 11.

When the color button Co of the color selector CS is depressed, a switch MS-CO assumes its NO (normally open) position to energize a relay A, which self-holds by its switch A-1. A relay B is energized due to the switch A-2 of the relay A being closed, but it is soon deenergized due to a capacitor being charged. The time set for the timer by the charging of the capacitor is sufficient for at least the filter to restore its initial location.

When a predetermined filter is not in its initial location, switches B-1 and MS3 are in NO position so that a relay C is energized. If a filter drive motor MT4 is in unlocked position, a switch MS-4 is in its NO position so that switches C-1 and A-3 are closed to drive the motor. Unlocking operation is accomplished with a transistor Tr1 being rendered conductive by a signal S1 generated at the end of developing process for each color to thereby energize a relay E and accordingly a solenoid SL-2.

For color reproduction, design is made such that the relay E is energized by a contact of a relay F which is energized by MS-2, to thereby energize the solenoid SL-2 in order to prevent locking from occurring at any other location than a predetermined filter. When the filter has come to its predetermined location, a developer driving signal Sy comes on to operate the developing device. For monochromatic reproduction, as described, depression of one of the buttons Y, M, C and BL causes a predetermined one of the microswitches MS (for Y, M, C and BL) to assume its NO position to energize a relay A'. If a predetermined filter is not in its initial position, the microswitch MS2 is in NC (normally closed) position so that the relay F is also energized. As a result, the contacts F-1 and A'-2 are closed to set the filter to its initial location.

For any color cycle, transistor Tr(R) is rendered conductive by a signal for completion of the cycle, to energize a relay G to open switches G-1 and G'-1 and thereby release the self-hold of the relay A or A' in preparation for a subsequent copying cycle.

The above-described control mechanism for the filter means will be described more specifically.

Figure 14:
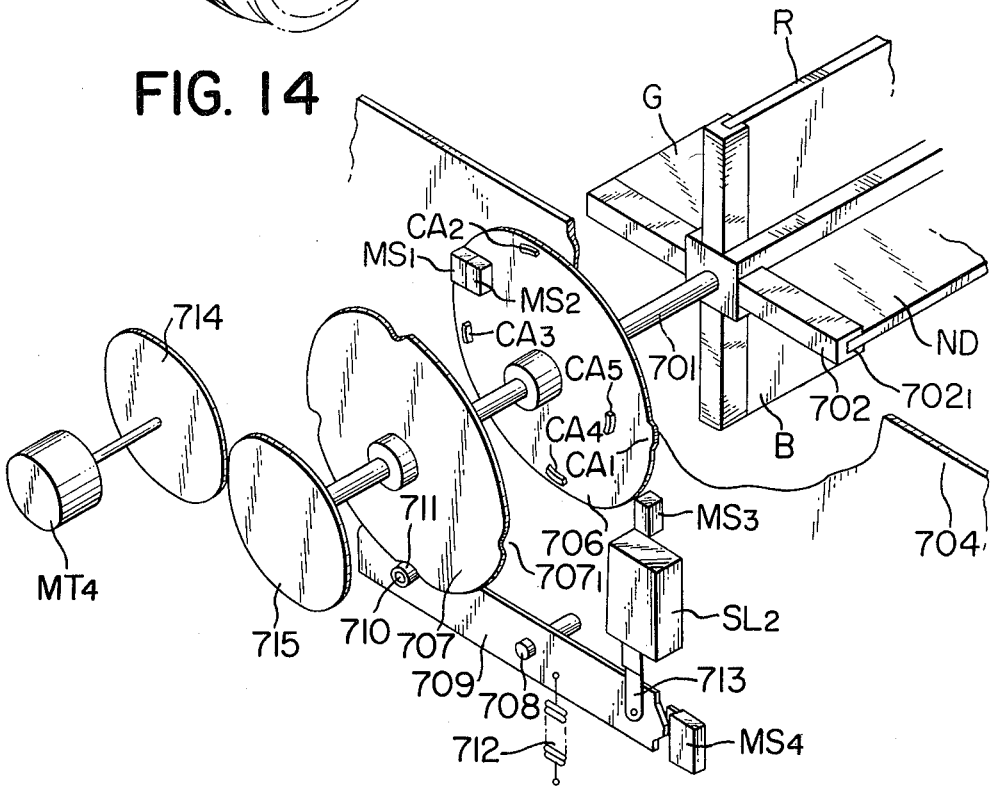
FIG. 14 is a perspective view illustrating the control mechanism in the filter portion.

Referring to FIG. 14, the filters R, G, B and ND are guided by guide grooves $702_1$ in filter support members 702 mounted on a filter shaft 701 in 90°-spaced relationship with one another, and are further positioned in place by plate springs. In the operative position of the filter means, the surface of a filter is at right angles with the optical axis.

Figure 15:
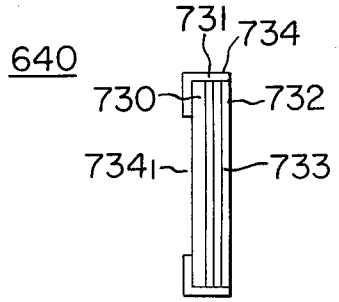
FIG. 15 is a sectional view illustrating a form of the filter.

In FIG. 15, which shows a form of the filter, there are transparent base plates 730 and 733 of glass or like material between which is a gelatine filter 732 and an ND filter 731 for balancing the quantity of light between various filters, thus providing a four-layer construction. Such four-layer construction is surrounded by a filter frame 734 and the marginal portions thereof are hermetically sealed against degeneration or oxidization of the gelatine due to humidity or other factor, thereby ensuring air-tightness and stable color resolving function to last for a long time.

The filter shaft 701 is rotatably journalled to the opposite side plates 704 and 705 of an optical box. On one end portion of the shaft 701 extending outwardly of the side plate 704, a control disc 706 and an index plate 707 are securely mounted in a predetermined relationship with the filter (although the disc and plate may of course be disposed on a common disc).

Control cams CA1, CA2, CA3, CA4 and CA5 are provided on the peripheral surface and end face of the control disc 706. The control cam CA1 designates the initial location of the color filter, and the control cams CA2, CA3 and CA4 correspond to the filters R, G and B, respectively. The control cam CA5 is the cam for the ND filter. Accordingly, the cams CA2, CA3, CA4 and CA5 are angularly spaced apart by 90° from one another, corresponding to the locations of the filters R, G, B and ND. The cams CA2, CA3 and CA4 are disposed on a common circumference, and a color filter selector switch MS1 for detecting the location of each of these cams is provided at a predetermined point on said common circumference. The cam CA5 is located on a different circumference so as not to affect the switch MS1, and a monochrome filter selector switch MS2 is disposed in contact therewith. Further, a cycle control switch MS3 which makes contact with the cam CA1 for controlling the color cycle during color reproduction is provided on the side plate 704 or the like at a predetermined point.

Next, the circumference of the index plate 707 is divided into four equal parts to form recesses $707_1$ for locking the index plate, and these recesses $707_1$ are maintained in a predetermined relationship with the above-described cams CA2 to CA5. A lock arm 709 is pivotally supported on a shaft 708 secured to the side plate 704, and a pin 710 is fixed on the lock arm 709 and has a roller 711 rotatably mounted thereon. The roller 711 may be engaged in a recess $707_1$ of the index plate 707 to lock the index plate. Connected to the other end of the lock arm 709 is an unlocking solenoid SL2 by an arm 713. The lock arm 709 so constructed is normally biased by a spring 712 so that the roller 711 is brought into contact with the peripheral surface of the index plate. Further, a filter driving motor MT4 is fixed to the side plate 704, and a gear 714 on the shaft of the motor MT4 engages a gear 715, securely mounted on the filter shaft, to transmit the drive.

In the above-described embodiment of the mechanism, when full color copies are to be produced, the print button Co is depressed to initiate the copying operation. When the filter means is not in its initial location, namely, when the initial location cam CA1 is deviated from the cycle control switch MS3, the lock arm 709 is necessarily out of engagement with a recess on the index plate while the solenoid SL2 is being operated by an instruction from the sequence control circuit and the cam CA6 at the end of the lock arm 709 adjacent the solenoid is actuating the unlocking microswitch MS4, so that the filter driving motor MT4 is operated to rotate the filter shaft 701. Thus, the control disc 706 is rotated to cause the initial location cam CA1 thereon to actuate the color cycle control switch MS3 while the solenoid SL2 is deenergized and at the same time, the motor MT4 is electrically braked. Thereupon, the lock arm 709 is rotated clockwisely about the shaft 708 by the spring 712, to thereby bring the roller 710 into engagement with a recess $707_1$ on the index plate 707, thus locking the filter shaft. Only in such position, printing becomes feasible and a copying cycle is initiated by the instruction from the sequence control circuit, which is followed by forward movement of the optical scanning system for illuminating and scanning the original to be copied, so that the reflected light from the original passes through a first selected filter, for example, the blue filter, whereby the light is color-resolved and passed to the photosensitive drum for exposure.

As soon as the optical system is reversed upon completion of the optical scanning for the original, the unlocking solenoid SL2 is electrically energized to pivot the lock arm 709 counter-clockwisely against the force of the spring 712 to provide for unlocking, and when the unlock detector switch MS4 is actuated by the cam CA6, the filter driving motor MT4 is electrically energized to rotate the filter shaft 701 counter-clockwisely and such rotation continues until the subsequent control cam CA2 engages the color filter selector switch MS1. When the switch MS1 is actuated by the control cam CA2, the filter driving motor MT4 is braked as previously described, so that the index plate 707 is locked with the lock arm engaged in a recess $707_1$, thus completing the filter change-over and initiating a subsequent scanning cycle to permit the red filter to effect color resolution for exposure. Similar operation is further repeated with the green filter and after exposure occurs through this filter, there is no cam to engage the switch MS1 at the location corresponding to the next ND filter and therefore, the filter means is rotated with the ND filter skipped over until the initial location switch MS3 is actuated by the cycle control cam CA1, whereupon the cycle of full color copying is completed.

Where monochromatic copies are to be produced, a predetermined copy button on the operating panel is selected to thereby carry out a predetermined color reproduction process. The unlocking solenoid SL2 is energized by a signal from the control circuit and subsequently, the unlock detector switch MS4 is actuated by the lock arm, whereupon the filter driving motor MT4 is electrically energized and rotated until the control cam CA5 for the ND filter actuates the monochrome filter selector switch MS2, and at the same time the solenoid SL2 is deenergized to lock the index plate 707 at a predetermined position, which is followed by scanning of the original for the formation of a latent image on the photosensitive drum, and such latent image is developed by a developer having a color preselected by the color selector button, thus providing a predetermined color of copy. The color selector buttons Y, M, C and BL and the four developing units correspond in the relationship of 1 : 1, so that selection of a color selector button determines a predetermined developing unit exclusively.

Paper Feed Mechanism

A paper feed mechanism will hereinafter be described with reference to FIGS. 16 to 23.

Figure 16:
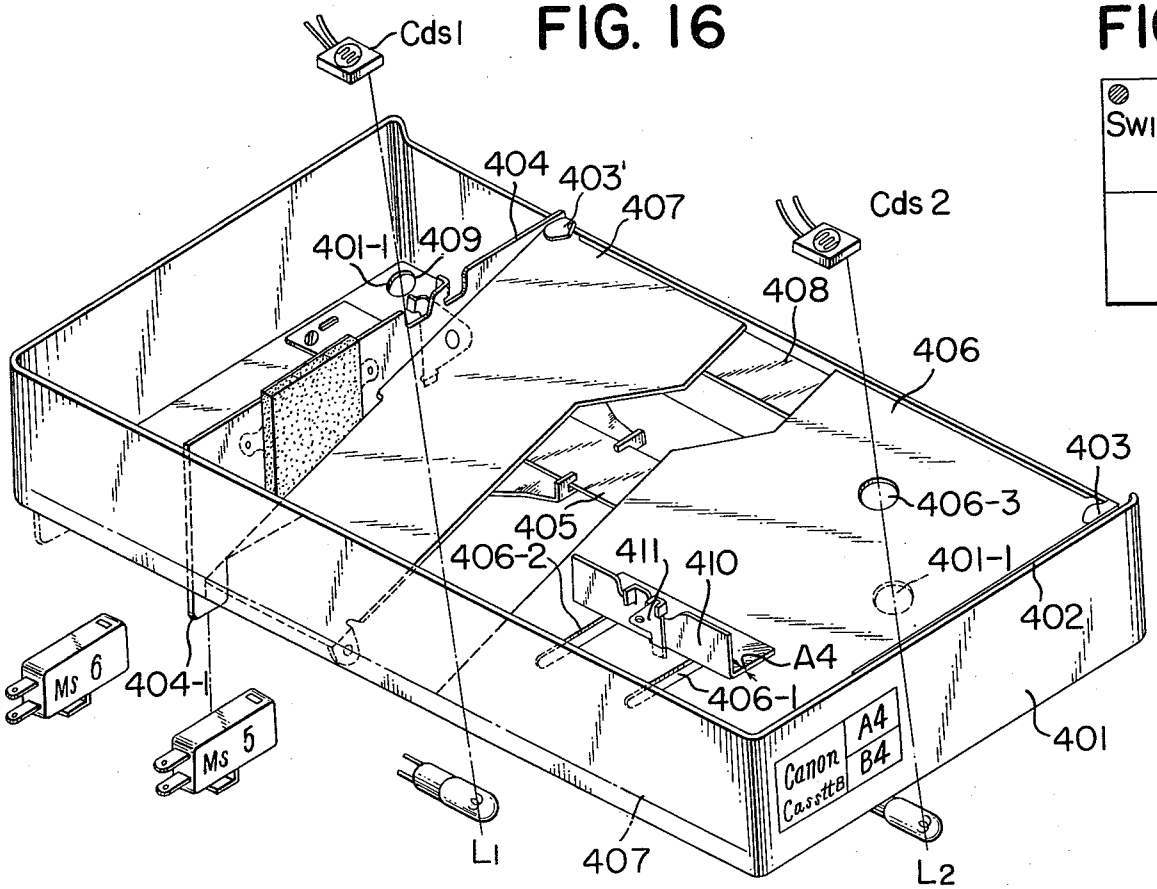
FIG. 16 is a perspective view of a paper supply cassette.

FIG. 16 shows a cassette constructed so as to be capable of accommodating therein different sizes of paper. The cassette includes a cassette housing 401 and a reference side plate 402 for positioning one side edge of transfer paper, the reference side plate being secured to the cassette housing 401 and having a separator pawl 403 pivotally mounted thereon. A movable side plate 404 movable in accordance with the size of transfer paper serves to position another side edge of transfer paper and has a separator pawl 403 also pivotally mounted thereon. The side plate 404 is movable along a rail 405. An intermediate plate for supporting thereon a supply of transfer paper is pivotable about a shaft 407 provided on the cassette housing 401, and is divided into an immovably fixed intermediate plate 406 and a movable intermediate plate 407 connected to the movable side plate 404. These intermediate plates are normally biased upwardly by a spring 409 which raises a plate 408. Likewise, a back plate 410 for positioning the rear end edge of transfer paper is movable along guide slots 406-1 and 406-2 formed in the intermediate plate 406. A step 409 is attached to the movable side plate 404 and adapted to be received in an opening formed in the rail 405. The back plate 410 is also designed such that its position is fixed by a similar means.

For the confirmation or detection of the presence of paper to be fed, openings 406-3 and 401-2 are formed through the intermediate plate 406 and the housing 401 so as to provide an optical path therethrough. For the detection of the copy size held by the cassette, a contact member 404-1 may be provided at the lower end of the movable side plate to actuate a microswitch MS5 or MS6 provided on the apparatus. Alternatively, an optical path forming opening 401-1 may effectively be provided in the housing so that light-interception or light-passage may be provided by movement of the movable intermediate plate 407. Means for the detection of copy size is not restricted to mechanical or optical means but any practically suitable means may of course be adopted.

The cassette constructed as described will further be explained with respect to the case where it is mounted to the aforesaid embodiment of the apparatus. In the operation illustrated in connection with FIG. 11, a cassette changeover instruction is provided. Since the size of the paper accommodated in the cassette is indicated on the operating panel, the operator can suitably select the copy paper to be used.

Figure 17:
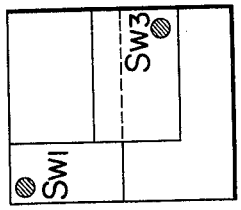
FIG. 17 is a plan view illustrating the arrangement and detection of differently sized copy sheets in the paper supply cassette.

Consider the case where two sizes A4 and B4 are exclusively used with the size detection effected optically. For the size A4, light from lamp 11 passes through the opening 401-1 in the cassette housing to reach a light-sensing element CdS1, so that the size A4 is indicated by a lamp which is turned on by the light-detection of the CdS. When the size B4 is accommodated in the cassette, the intermediate plate and the movable side plate cover the opening 401-1 so that the light-sensing element CdS1 does not sense the light and the size B4 is indicated by a lamp which is turned on when the CeS does not detect the light. Where mechanical detection is adopted in lieu of such optical detection, microswitches MS5 and MS6 are disposed so as to be closed in the positions of the movable side plate corresponding to the respective sizes. By doing so, size indication may be effected such that the size A4 is indicated when the downwardly facing projection of the movable side plate actuates the microswitch MS5 and that the size B4 is indicated when the projection actuates the microswitch MS6. Particularly, when only two different sizes of paper are used, a microswitch MS6 alone may conveniently be provided in such a manner that the NO (normally open) side thereof represents the indication of size A4 while the NC (normally closed) side thereof represents the indication of size B4. The same effect may also be obtained by detecting the position of the back plate 410, instead of the position of the movable side plate 404. Thus, the present construction of the cassette enables multi-size detection to be readily accomplished and, where four different sizes of copy paper such as A4, B4, A3 and B3 are arranged and inserted in the manner as shown in FIG. 17, detection of paper by two-position switches SW1 and SW2 will no doubt enable the size discrimination. Such size discrimination or detection may readily be indicated either by mechanically detecting the positions of the movable side plate and back plate or by light-detection of light-sensing elements provided at the two positions.

If the scanning distance of the optical system driving mechanism is adjusted in response to the operation of detecting the size of copy paper to be supplied from such cassette, the scanning time required for the copying of size A4 will only be half the scanning time for size A3 and this means a reduced copying time.

Moreover, an optimum copy process time can be selected by designating a copy size during operation and this advantageously eliminates any control mechanism in the course of the process.

When the copy paper in the cassette is exhausted, the light-sensing element CdS2 detects the light from the lamp L2 through the opening in the intermediate plate 406 to turn on a paper replenishment lamp on the indicator panel, whereby a predetermined control operation occurs.

Figure 18:
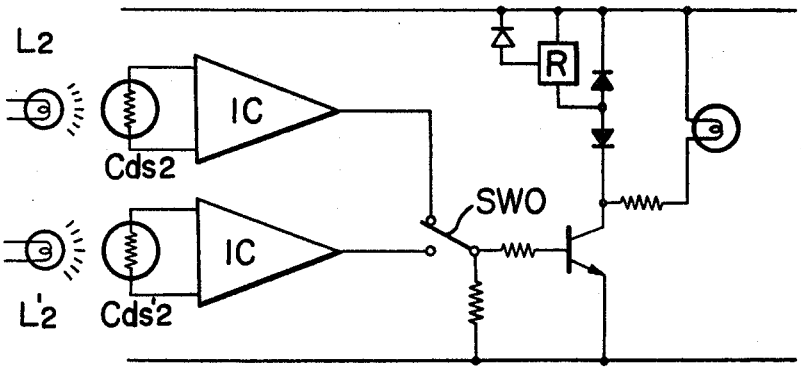
FIG. 18 is a diagram showing the change-over circuit for multi-stage cassettes.

FIG. 18 shows an example of the circuit effecting such control, wherein a relay R for controlling the drive source such as main motor or the like of the apparatus is operable simultaneously with the turn-on of the paper replenishment lamp.

In case where there is a plurality of cassettes as in the present embodiment of the apparatus, even though one of the cassettes becomes empty, copying may be continued by switching over the paper feed cassette selector switch SW0 on the panel as long as another cassette still contains therein transfer paper of the same size.

Thus, the mechanism described above enables quantities of transfer paper of various sizes to be contained and supplied.

In the present embodiment of the apparatus, on the other hand, there is provided a plurality of cassettes 40 from which transfer paper is fed to the transfer station, and transport passages from respective cassettes through the first sets of timing rollers 35 merge into a single passage at the second set of timing rollers 32, 33 and the single passage further extends to the transfer station. Since the second timing rollers serve to provide complete timing between the image on the photosensitive drum and the positioning of the transfer paper, no misalignment may occur in the image transfer irrespective of different lengths of the transport passages from the respective cassettes to the second timing rollers.

Moreover, the presence of the first timing rollers prevents the feed timing from being lost and can also modify the curvature of transfer paper fed from a cassette into a transport passage, thus eliminating the possibility of paper jamming. If such first timing rollers were absent and if transfer paper were fed obliquely with respect to the direction of transport, the curvature of the paper would be enlarged during its transport and accordingly increase the possibility of jamming.

The above-described arrangement provides improved timing and enables paper transport to occur without misfeeding.

Fixing Mechanism

After image transfer has been done, the transfer paper is separated from the transfer roller by the separator pawl and passed to the fixing device, as previously described. A specific example of the mechanism will hereinafter be described.

Figure 19:
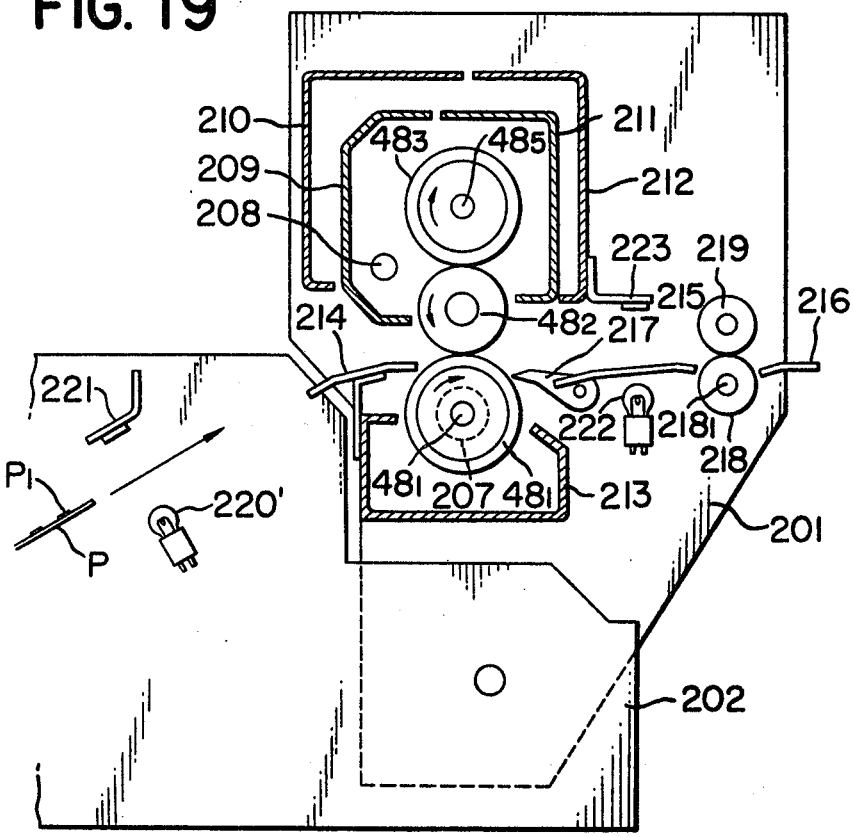
FIGS. 19 to 22 illustrate a fixing device.

FIG. 19 is a cross-sectional view of the fixing mechanism as seen from the back side thereof. Heaters 207 and 208 are provided within or outside and adjacent to rigid rollers $48_1$ and $48_3$ journalled to the machine frame of the copying machine, and a resilient roller $48_2$ is mounted between the rollers $48_1$ and $48_3$ in pressure contact relationship therewith.

Figure 22:
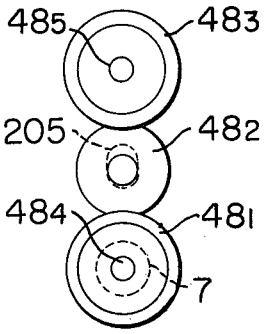
Figure 23:
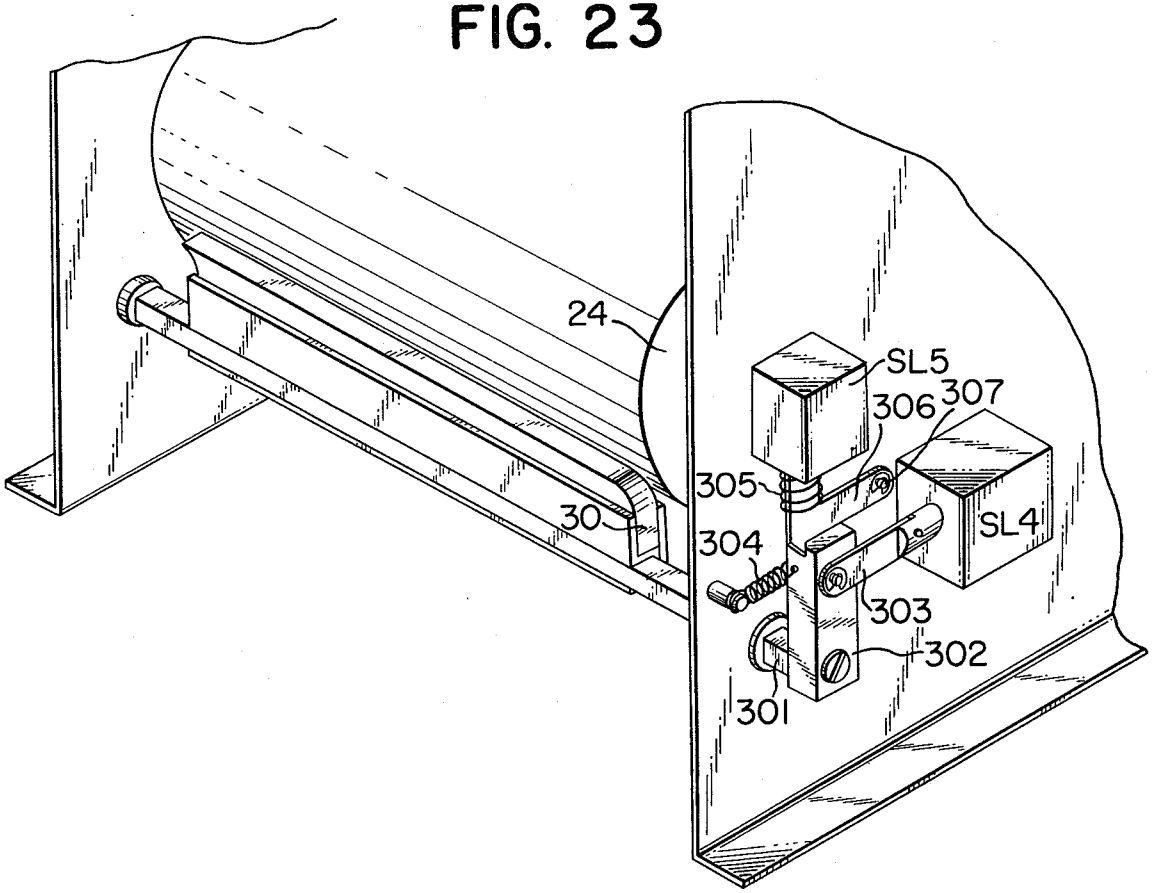
FIGS. 23 to 25 are a perspective view and sectional views, respectively, illustrating a cleaning mechanism for transfer roller.

The resilient roller $48_2$ is preferably formed of non-adherent material such as silicone rubber or the like to prevent offset, since the roller $48_2$ is to make contact with the toner-bearing surface of transfer paper. Also, in the absence of transfer paper, the resilient roller $48_2$ should preferably be out of pressure-contact to increase its service life because this roller is subjected to high temperature and pressure force. Therefore, as shown in FIG. 22, for example, the resilient roller $48_2$ is made movable along a bearing slot 205 formed in the machine frame while the roller $48_1$ is made vertically movable by a vertically moving mechanism so as to vary the contact pressure of the resilient roller $48_2$.

Adiabatic members 209 to 213 are provided around the rollers to shield the outside from the influence of the heaters 207 and 208 and to increase the thermal efficiency in the interior. Unfixed transfer paper is passed into the fixing device and fixed therein, whereafter it is discharged. Guide plates 214 and 216, separator pawl 217 and discharge rollers 218 and 219 are disposed along the transport passage. Two sets of clamps 220, 222 and light-sensing elements 221, 223 for detecting the arrival and discharge of transfer paper are disposed on the opposite sides of the transport passage.

Figure 20:
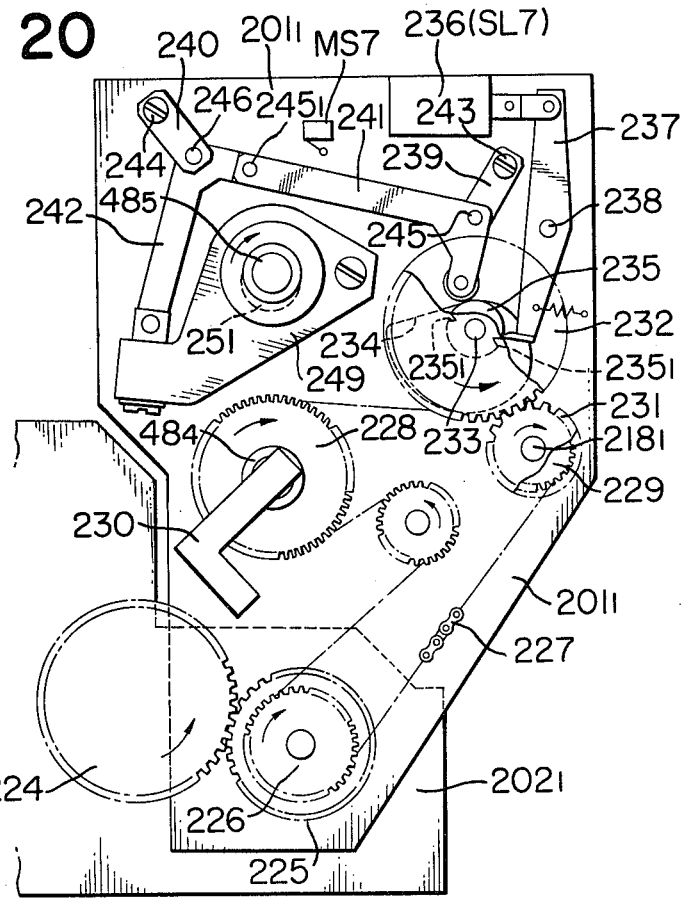

FIG. 20 shows a driving mechanism provided outside the machine frame $201_1$ on this side, as viewed in the drawing. Designated by $48_4$, $48_5$ and $218_1$ are the shafts of rollers $48_1$, $48_3$ and 218, and the drive from an unshown drive source is transmitted through gears 214 and 225, sprocket 226 and chain 227 to sprockets 228 and 229, which in turn drive the respective rollers. On the other hand, the rollers $48_2$ and $48_3$ are rotated by frictional transmission from the roller $48_1$. A member 230 supports the heater 207 within the roller $48_1$ and also delivers an electric power to that heater.

The fixing rollers $48_1$, $48_2$ and $48_3$ are maintained in their positions shown in FIG. 20 until copy paper P enters the fixing device. More specifically, these rollers are maintained in contact with one another by a pressure force necessary to frictionally transmit the rotational force of the normally rotating roller $48_1$ to the rollers $48_2$ and $48_3$. (Such condition is hereinafter referred to as "light pressure-contact condition".) The fact that the rollers are always rotating in this way is effective to provide uniform heat diffusion over the roller surfaces and thus prevent deterioration of the rollers.

Figure 21:
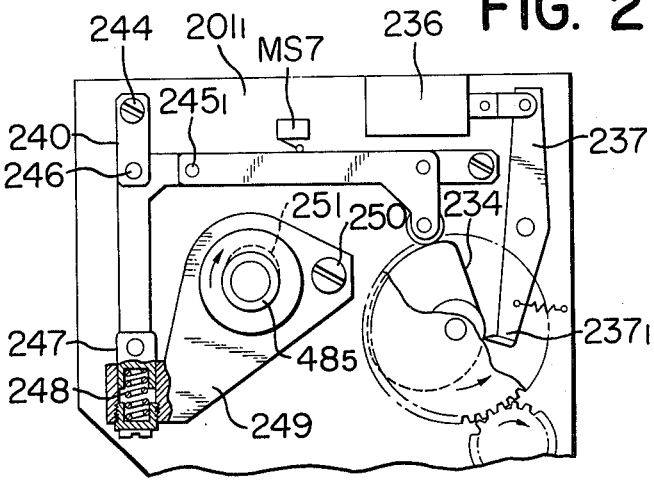

In the fixing condition, the rollers $48_1$, $48_2$ and $48_3$ are brought to their positions shown in FIG. 21. More specifically, the resilient roller $48_2$ is urged against the rigid roller $48_1$ by the rigid roller $48_3$ to such an extent that it is concavely deformed to make pressure-contact with the rigid roller $48_1$, and thus the resilient roller is given a good pressure for fixation. (Such condition is hereinafter referred to as "heavy pressure-contact condition".) Various types of the mechanism for effecting the change-over between these two pressure conditions would occur to mind, but a toggle joint pressure mechanism will be shown and described herein.

A shaft 233 rotated by the discharge roller 218 through the gears 231 and 232 is provided thereon with a cam 234 for effecting change-over between the light pressure-contact and the heavy pressure-contact, and this cam 234 is engaged and disengaged with the shaft 233 through the clutch 235. Designated by 236 (SL7) is an electromagnetic plunger for operating the clutch 235, numeral 237 is a clutch control pivotable about the shaft 238 by the electromagnetic plunger 236, and numerals 239–242 designate a toggle joint mechanism whose arms 239 and 240 each have one end attached to shafts 243 and 244 and the other end connected to actuating arms 241 and 242 by means of pins 245, $245_1$ and 246. The actuating arm 241 is opposed to the cam 234 and the arm 242 is operatively associated with a bearing 249 through a piston 247 and a compression spring 248.

The bearing 249 is attached to a machine frame $201_1$ by means of a shaft 250 and supports the shaft $48_5$ of the rigid roller $48_3$. The cam 234 is normally in the position shown in FIG. 20 and does not act on the toggle joint mechanism 237–242. Thus, the toggle joint mechanism is biased into the shown position by the spring 248 and its urging action with respect to the bearing 249, that is, its force urging the roller $48_3$ downwardly is weak, so that the roller $48_1$, $48_2$ and $48_3$ are in the position shown in FIG. 19. An aperture 251 for permitting vertical movement of the shaft $48_5$ is provided in the machine frame $201_1$.

When the copying machine is started, the gear 224 is rotated to drive the roller $48_1$ and the rollers $48_2$ and $48_3$ are also rotated by frictional transmission thereto from the roller $48_1$, and all these rollers and their parts are heated by the heaters 207 and 208 to a uniform temperature without any temperature gradient.

When the detector elements 220, 221 detects the leading end of the developed copy paper P to produce a signal, the electromagnetic plunger 236 is energized to cause the end $237_1$ of the control 237 to be received into the groove 235 on the outer sleeve of the spring clutch 235 having a coil spring therein, thus operating the clutch 235 to bring the cam 234 into engagement with the shaft 233. The cam 234 is rotated counter-clockwise to raise one end of the actuating arm 241 of the toggle mechanism in the manner as shown in FIG. 21, so that the toggle mechanism assumes its position of FIG. 21 with its movement controlled by the arms 239 and 240, thus depressing the bearing 249 through the agency of pin 247 and spring 248. Thereupon, the roller $48_3$ is lowered to urge the resilient roller $48_2$, whereby the rollers $48_4$, $48_1$ and $48_3$ establish the heavy pressure-contact condition as shown in FIG. 22.

After the movement of the toggle mechanism is checked up by the microswitch MS7 or after a time determined by the timer has passed, the current flow to the electromagnetic plunger 236 is cut off to cause disengagement of the clutch 235 and maintain the cam 234 in that condition.

The copy paper P passes between the rollers $48_1$ and $48_2$ to have the image P1 thereon fixed, whereafter the elements 222 and 223 detect the passage of the trailing end of the copy paper to produce a signal, which again energizes the electromagnetic plunger 236 to cause engagement of the clutch 235 to rotate the cam 234 counter-clockwisely into the initial position of FIG. 20 and thereby deenergize the electromagnetic plunger 236 and cam 235, thus returning the toggle joint mechanism 239–242 to the position of FIG. 20. As a result, the rollers $48_1$, $48_2$ and $48_3$ are also returned to the light pressure-contact condition shown in FIG. 19.

Transfer Roller Cleaning Mechanism

Cleaning of the transfer roller 24 in FIG. 1 will hereinafter be described by reference to FIGS. 23 to 26*a, b, c* and *d*.

A transfer roller cleaner 30 is supported by a square shaft 301 and has an arm 302 secured to one end of the square shaft. When the cleaning operation is to be effected, a solenoid SL4 is supplied with a current to attract an arm 303 engaged with the arm 302, to thereby rotate the square shaft 301 clockwisely against the force of the spring 304, whereby the cleaner 30 is urged into contact with the transfer roller. The arm 302 is held in such condition by the action of a lock 306 given a tension by a spring 305. To release the cleaner 30 from its cleaning position, a solenoid SL5 is supplied with a current to unlock the lock 306. Thus, the cleaner 30 is released from its urged position with respect to the transfer roller by the return force of the spring 304.

The above-described construction of the mechanism eliminates the necessity of providing a drive source for the cleaner and is effective in providing a compactness. However, a considerably high power solenoid is required to urge the cleaner against the roller and this might cause noise to be created during use.

Figure 24:
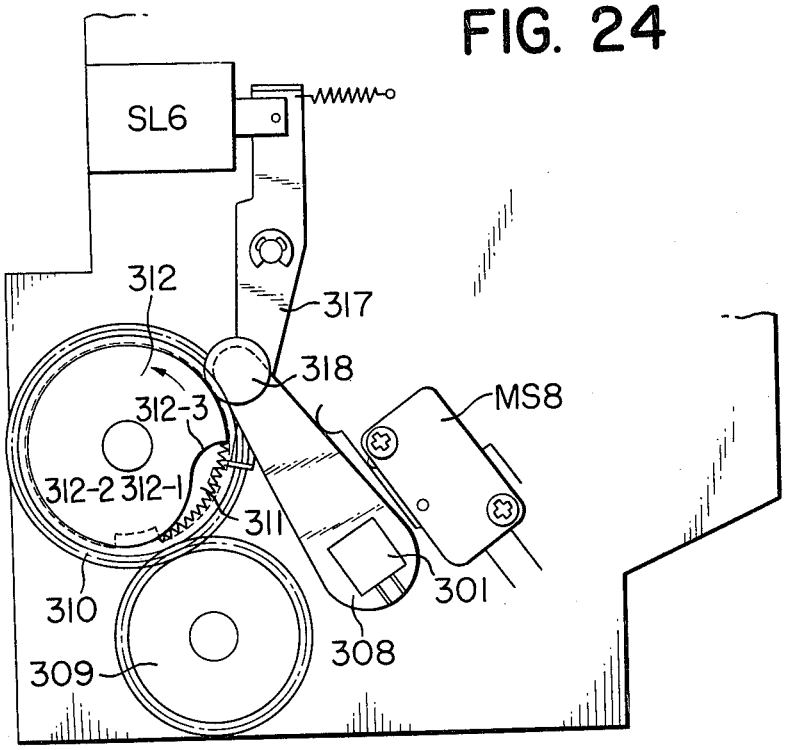
Figure 25:
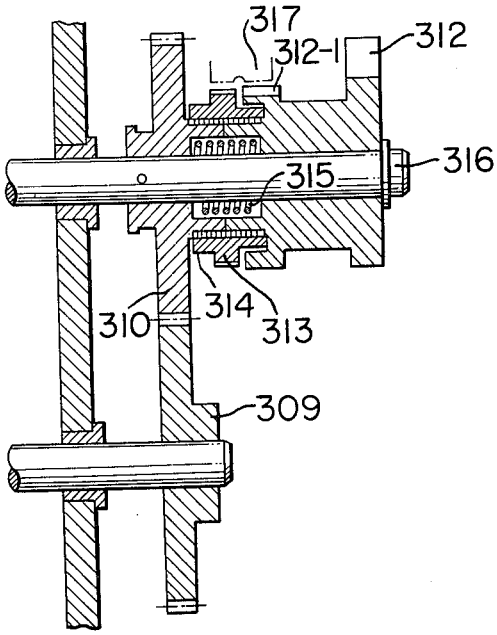

The device shown in FIGS. 24 and 25 is of a design whereby the attraction noise of the solenoid may be reduced.

An arm 308 is fixed at one end to the square shaft 301 supporting the transfer roller cleaner 30, and a guide 318 is fixedly or pivotally mounted on the other end of the arm 308. The guide 318 engages a cam 312 which is connectible to a normally rotating gear 310 by means of a clutch spring 314.

A gear 309 is mounted on the screw 29 to transmit the drive to the gear 310. When cleaning is desired, a solenoid SL6 is supplied with a current. Thus, since a shaft 316 is rotating, the cam 312 is also rotated through the agency of the clutch spring 314. When a predetermined recess 312-1 formed in the cam has come round to face a stop 317, the stop is received in that recess and acts on a thin pawl on the outer wheel 313 of the clutch spring to loosen the clutch spring 314 and stop the cam 312 from rotating (FIG. 25). Under such condition, the cleaner is held urged against the transfer roller. When the cleaner is to be released from its urged position, the solenoid SL6 is supplied with a current to disengage the stop 317 from the recess 312-1 and the pawl on the outer wheel 313, thereby permitting rotation of the cam 312. When the guide 318 of the arm 308 is received in a cam recess 312-2, the microswitch MS4 is opened to cut off the current supply to the solenoid SL6, whereby the stop holds the pawl on the outer wheel 313 and the cam recess 312-2. Thus, by providing the microswitch MS4 and by simply forming the cam with the urging recess 312-1 and the separating recess 312-2, it is feasible to eliminate the possibility that any objectionable movement might occur during the overrun when the stop is caused to act alternately.

In the above-described device, it will be apparent that the urging and separation of the cleaner with respect to the transfer roller may be accomplished automatically in accordance with a predetermined sequence.

Figure 26A:
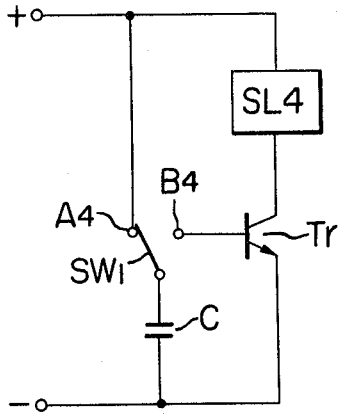
FIGS. 26*a* to 26*d* diagrammatically show various forms of the cleaning operation control circuit.

Control of the operation of the cleaner in accordance with paper size will now be described. In the above-described device, when sizes A4 and B4 of transfer paper are used and if copies of the same size are first to be continuously produced, then any sheet of such transfer paper will always ride on the transfer roller at the same location thereof with the back side of the paper being never stained, because the diameters of the photosensitive drum and transfer roller are at an integral ratio. Therefore, the transfer roller need not be cleaned during A4-size copying, and cleaning is required only once before a first sheet of size B4 is copied in subsequence to the A4-copying. An example of the circuit arrangement corresponding thereto is shown in FIG. 26*a*. When the copy size change-over switch is first closed at the A4 side, a suitable quantity of charge is stored in a capacitor C. When the switch is next closed at the B4 side, the current is amplified through a transistor Tr and supplied to the solenoid SL4, so that the cleaner 30 is urged against the transfer roller 24 to bring about an operative condition.

In the above-described embodiment of the copying apparatus, there is a control mechanism for effecting the change-over between the three-round color transfer for colored copy and the single-round transfer for monochromatic copy and therefore, in accordance with the copy mode selected by that control mechanism, a current can of course be supplied to the solenoid SL5 to release the cleaner from the transfer roller.

Figure 26B:
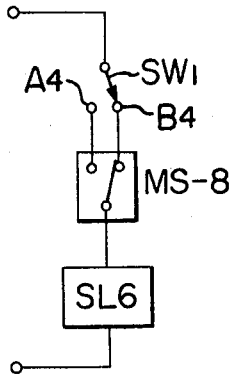

The example of the circuit shown in FIG. 26*b* is applicable to the construction of FIGS. 24 and 25. In this case, the microswitch MS4 is at the NC side when the cleaner 30 is in its released position. When the size change-over switch is shifted to the B4 side, the solenoid SL6 is supplied with a current to rotate the cam 312. As a result, the arm 308 is moved through the guide 318 along the cam 312 to push the actuator of the microswitch MS1. Switch MS8 is shifted to the NO side to cut off the current supply to the solenoid SL6 to permit the stop 317 to enter the recess 312-1 of the cam and engage the pawl on the outer wheel 311, thereby stopping the cam, as previously described. Even if the stop 317 comes to the position of the cam recess 312-2 due to overrunning, the MS1 is at the NC side because the guide 318 of the arm 308 is at the position of the recess 312-3, and thus the stop 317 does not enter the recess 312-2 during energized condition of the solenoid SL6. Release from the cleaning operation may be accomplished by a switch SW2 (not shown) which performs a function similar to the shifting of the size change-over switch to the A4 side.

Further, the controlled contact and separation of the cleaner is pronouncedly effective to prevent blur of the copy image.

More specifically, control is effected such that movement of the cleaner does not occur during the exposure to the original image or during transfer of developed image onto transfer member. The transfer roller 24 is connected to the photosensitive drum by a gear having an appropriate tooth-number ratio, and the photosensitive drum in turn is connected to the drive motor through several gears and chains, and the optical system is also connected to the drive motor through several intermediate transmission means. It is usual with such type of machine that there is a backlash of 0.1 to 0.2 and that when the cleaner 30 touches the transfer roller 24 there is a considerable brake applied to the latter, as a result of which the process speed of the photosensitive drum and/or the optical system tends to fluctuate. Above all, in a case where a common drive source is divided into two drives, one for driving the drum and transfer roller and the other for driving the optical system (mirrors), the tooth surfaces of the engaging gears between the two drives are separated at the moment when the cleaner touches the transfer roller and as a result, there is a greater possibility of causing blur of the exposure image or the transferred image.

Figure 26C:
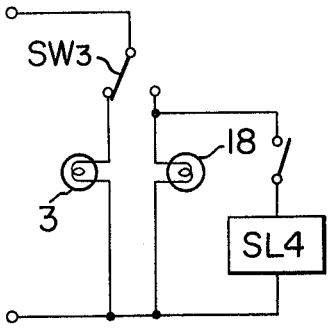

In a specific example of the control mechanism, as shown in FIG. 26*c*, an exposure control switch SW3 is connected so as to be operated during turn-off of the exposure lamps and a further switch adapted to open during transfer operation is connected to control the solenoids SL4 to SL6 in accordance with the various modes of embodiment.

Figure 26D:
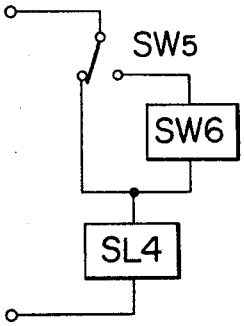

FIG. 26*d* shows a circuit arrangement for controlling the change-over between color copying and monochromatic copying. A color selector switch SW5 effects change-over between monochromatic copying and color copying, and for color copying, a switch SW6 is closed with a predetermined frequency.

As has hitherto been described with respect to a specific embodiment, the apparatus of the present invention is highly effective in accomplishing good color reproduction at high speeds.

Moreover, the design of the apparatus which readily permits selection of any desired color reproduction cycle leads to excellent operability and high usefulness.

In addition, the apparatus of the present invention can achieve color reproduction with good registration and can produce copies of very high quality free of stains on the back side.

Furthermore, design considerations are given such that mutual cooperations are provided between various process means in accordance with the change-over thereof, and this permits a great variety of sequences to be obtained, which also means a very high practical value of the apparatus.

We claim:

1. A copying apparatus for forming a single electrostatic latent image selectively having one of a plurality of color components of an original image, or sequentially forming a plurality of electrostatic latent images corresponding respectively to said plurality of color components, said images being formed on a moving photosensitive medium, said apparatus comprising:

a photosensitive medium;

means movably mounting said photosensitive medium;

exposure means for projecting therethrough an original image upon said photosensitive medium for exposure;

filter means including a predetermined number of color resolving filter units selectively movable into the projection path of said exposure means;

position signal generating means for generating a signal in response to the movement of any of said filter units into the projection path of said exposure means;

primary position signal generating means for generating a signal in response to the setting of said filter units into a predetermined primary position;

means disposed adjacent said photosensitive medium to form an electrostatic latent image on said photosensitive medium corresponding to the projected image;

selector means for selecting between a first mode of operation wherein any one of a plurality of color image components of an original is formed on said photosensitive medium, and a second mode wherein said plurality of color image components of an original are formed on said medium; and program control means having an input coupled to said selector means and including means for detecting a signal from said position signal generating means and means for detecting a signal from said primary position signal generating means, said program control means being operable to detect, when the second mode has been selected by said selector means, whether a predetermined one of said filter units extends across the projection path of said exposure means, and, if it does not so extend, drive said filter means to position said predetermined filter unit across the projection path.

2. A copying apparatus according to claim 1, wherein said exposure means includes a slit exposure opening through which the original image is projected, and a lens for focussing the image upon the photosensitive medium, wherein each of said filter units has an area of rectangular configuration similar to said slit opening and wherein said filter units are spaced from said lens.

3. A copying apparatus according to claim 2, wherein said filter means are provided with a rotatable shaft on which said filter units are supported, and on which an index plate is fixed, and also on which said position signal generating means and said primary position signal generating means are mounted, wherein said rotatable shaft is disposed substantially normal to the projection path of the exposure means.

4. A copying apparatus according to claim 3, wherein said filter means are further provided with a locking mechanism which is operable to stop rotation of said filter units at a predetermined position in the projection path of said exposure means.

5. A copying apparatus in which images having color components of an original image are sequentially formed on a moving photosensitive medium to form a colored image thereon, said apparatus comprising:

a photosensitive medium;

means movably mounting said photosensitive medium;

exposure means for projecting therethrough an original image upon said photosensitive medium;

filter means having a predetermined number of color resolving filter units selectively movable into the projection path of said exposure means;

position signal generating means for generating a signal in response to the movement of said filter units into the projection path of said exposure means;

primary position signal generating means for generating a signal in response to the setting of said filter units into a predetermined primary position;

electrostatic latent image forming means arranged along said photosensitive medium;

developing means having a predetermined number of developing units using predetermined color developers to develop the latent images formed on said photosensitive medium; and program means having positional signal detecting means and primary position signal detecting means for controlling sequential color reproduction when both said position and primary position signals are detected.

6. A copying apparatus in which images having color components of an original image are sequentially formed on a moving photosensitive medium, said apparatus comprising:

a photosensitive medium;

means movably mounting said medium;

exposure means for projecting therethrough an original image upon said photosensitive medium for exposure;

filter means driven independently of movement of said photosensitive medium and having a predetermined number of color resolving units selectively movable into the projection path of said exposure means;

position signal generating means for generating a signal in response to the movement of any of said filter units into the projection path of said exposure means;

primary position signal generating means for generating a signal in response to the setting of said filter units into a predetermined primary position;

electrostatic latent image forming means for forming an electrostatic latent image on said photosensitive medium corresponding to the projected image;

developing means using predetermined color developers to develop the latent images formed on said photosensitive medium upon exposure effected by said exposure means;

transfer means for holding a transfer medium and contacting the same with said photosensitive medium to transfer the developed images onto said transfer medium; and program means including means for detecting a signal from said position signal generating means and means for detecting a signal from said primary position signal generating means and operable upon detection of said signal or signals from said generating means to control the operation of said copying apparatus in accordance with the color or sequence of colors to be reproduced.

7. A copying apparatus according to claim 6, wherein said exposure means includes a slit exposure opening through which the original image is projected and a lens for focussing the image upon the photosensitive medium, wherein each of said filter units has an area of rectangular configuration similar to said slip opening and wherein said filter units are spaced from said lens.

8. A copying apparatus according to claim 6, wherein said exposure means includes a slit exposure opening through which the original image is projected and a lens for focussing the image upon the photosensitive medium, wherein each of said filter units has an area of rectangular configuration similar to said slit opening and wherein said filter units are spaced from said lens.

9. A copying apparatus for forming a single electrostatic latent image selectively having one of a plurality of color components of an original image, or sequentially forming a plurality of electrostatic latent images corresponding respectively to said plurality of color components, said images being formed on a moving photosensitive medium, said apparatus comprising:

a photosensitive medium;

means endlessly movably mounting said photosensitive medium;

exposure means for projecting therethrough an original image upon said photosensitive medium for exposure;

filter means including a predetermined number of color resolving filter units selectively movable into the projection path of said exposure means;

position signal generating means for generating a signal in response to the movement of any of said filter units into the projection path of said exposure means;

primary position signal generating means for generating a signal in response to the setting of said filter units into a predetermined primary position;

means disposed adjacent said photosensitive medium to form an electrostatic latent image on said photosensitive medium corresponding to the projected image;

selector means for selecting between a first mode of operation wherein any one of a plurality of color image components of an original is formed on said photosensitive medium, and a second mode wherein said plurality of color image components of an original are formed on said medium;

program control means having an input coupled to said selector means and including means for detecting a signal from said position signal generating means and means for detecting a signal from said primary position signal generating means, said program control means being operable to detect, upon selection of said second mode by said selector means, whether a predetermined one of the filter units is placed across the projection path of said exposure means, and, if it is not placed, drive said filter means to place the predetermined one across the projection path;

developing means using predetermined color developers to develop the latent images formed on said photosensitive medium upon exposure effected by said exposure means; and transfer means for supporting a transfer medium and contacting the same with said photosensitive medium to transfer developed images onto said transfer medium.

10. An apparatus according to claim 9, wherein said program control means stops, upon selection of the second mode by said selector means, the operation of at least said exposure means until the predetermined one of the filter units is placed across the projection path.

11. An apparatus according to claim 9, wherein said filter means includes means for supporting the filter units rotatably about an axis substantially perpendicular to the projection path.

12. A copying apparatus according to claim 9, wherein said exposure means includes a slit exposure opening through which the original image is projected and a lens for focussing the image upon the photosensitive medium, wherein each of said filter units has an area of rectangular configuration similar to said slit opening and wherein said filter units are spaced from said lens.

13. A copying apparatus according to claim 11, wherein said filter means are provided with a rotatable shaft on which said filter units are supported, and on which an index plate is fixed, and also on which said position signal generating means and said primary position signal generating means are mounted, wherein said rotatable shaft is disposed substantially normal to the projection path of the exposure means.

14. A copying apparatus according to claim 13, wherein said filter means are further provided with a locking mechanism which is operable to stop rotation of said filter units at a predetermined position in the projection path of said exposure means.

15. A copying apparatus according to claim 6, wherein said photosensitive medium is endlessly rotatable.

16. A copying apparatus according to claim 1, wherein said program control means stops, upon selection of the second mode by said selector means, the operation of at least said exposure means until the predetermined one of the filter units is placed across the projection path.

17. A copying apparatus according to claim 1, wherein said filter means includes a means for supporting the filter units rotatably about an axis substantially perpendicular to the projection path.

18. A copying apparatus according to claim 5, where said filter means includes means for supporting the filter units rotatably about an axis substantially perpendicular to the projection path.

19. A copying apparatus according to claim 6, wherein said filter means includes means for supporting the filter units rotatably about an axis substantially perpendicular to the projection path.

* * * * *

UNITED STATES PATENT OFFICE

CERTIFICATE OF CORRECTION

Patent No. 4,095,879 Dated June 20, 1978

Inventor(s) HAJIME KATAYAMA, ET AL.

It is certified that error appears in the above-identified patent and that said Letters Patent are hereby corrected as shown below:

| | |
|---|---|
| Column 16, line 28 | Change "step" to --stop--. |
| line 57 | Change "11" to --L1--. |
| Column 18, line 47 | Change "clamps" to --lamps--. |
| Column 19, line 67 | Change "$48_4$, $48_1$ and $48_3$" to --$48_1$, $48_2$, and $48_3$--. |

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*